US006416924B1

(12) United States Patent
Oka et al.

(10) Patent No.: US 6,416,924 B1
(45) Date of Patent: Jul. 9, 2002

(54) SILVER HALIDE PHOTOGRAPHIC MATERIAL AND METHOD FOR PROCESSING THE SAME

(75) Inventors: Yutaka Oka; Tokuju Oikawa, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/713,253

(22) Filed: Nov. 16, 2000

(30) Foreign Application Priority Data

Nov. 16, 1999 (JP) ..... 11-324940

(51) Int. Cl.[7] ..... G03C 1/10
(52) U.S. Cl. ..... 430/264
(58) Field of Search ..... 430/264

(56) References Cited

U.S. PATENT DOCUMENTS

| | | | | |
|---|---|---|---|---|
| 4,746,593 A | | 5/1988 | Kitchin et al. | 430/264 |
| 4,761,362 A | * | 8/1988 | Sasaoka et al. | 430/264 |
| 4,786,587 A | | 11/1988 | Kuwabara | 430/566 |
| 4,957,849 A | * | 9/1990 | Inoue et al. | 430/264 |
| 5,589,318 A | * | 12/1996 | Dale et al. | 430/264 |
| 5,591,561 A | * | 1/1997 | Arai et al. | 430/264 |
| 5,616,446 A | * | 4/1997 | Miura et al. | 430/264 |
| 5,618,661 A | * | 4/1997 | Sampei | 430/264 |
| 5,721,094 A | * | 2/1998 | Komatsu et al. | 430/264 |
| 5,753,409 A | * | 5/1998 | Takabayashi et al. | 430/264 |
| 5,766,821 A | * | 6/1998 | Muramatsu et al. | 430/264 |
| 5,780,198 A | * | 7/1998 | Goto et al. | 430/264 |
| 5,834,176 A | * | 11/1998 | Ishikawa et al. | 430/264 |
| 5,837,418 A | * | 11/1998 | Arai et al. | 430/264 |
| 6,114,081 A | * | 9/2000 | Oikawa | 430/264 |
| 6,171,753 B1 | * | 1/2001 | Oikawa | 430/264 |

FOREIGN PATENT DOCUMENTS

| | | | |
|---|---|---|---|
| EP | 0 531 014 | * | 3/1993 |
| EP | 0 745 892 A1 | | 12/1996 |
| JP | A-64-15735 | | 1/1989 |

OTHER PUBLICATIONS

Patent Abstracts of Japan—02097936 (Apr. 10, 1990).
European Search Report dated Dec. 18, 2001.

* cited by examiner

*Primary Examiner*—Hoa Van Le
(74) *Attorney, Agent, or Firm*—Sughrue Mion, PLLC

(57) ABSTRACT

A silver halide photographic material is described, which comprises a support having provided thereon at least one light-sensitive silver halide emulsion layer and at least one light-insensitive hydrophilic colloid layer, wherein the at least one light-sensitive silver halide emulsion layer contains at least two kinds of silver halide emulsions having different speeds, the light-insensitive hydrophilic colloid layer contains at least one kind of light-insensitive silver halide grains, the silver halide emulsion layer or the light-insensitive hydrophilic colloid layer contains at least one kind of hydrazine derivative as a nucleating agent, and at least one kind of compound selected from the group consisting of an amine derivative, an onium salt, a disulfide derivative and a hydroxymethyl derivative as a nucleation accelerator. A method for processing the silver halide photographic material is also described.

6 Claims, 1 Drawing Sheet

SILVER HALIDE PHOTOGRAPHIC MATERIAL AND METHOD FOR PROCESSING THE SAME

FIELD OF THE INVENTION

The present invention relates to a silver halide photographic material and, in particular, to a silver halide photographic material of super-high contrast for use in photomechanical process.

BACKGROUND OF THE INVENTION

An image-forming system which shows super high contrast photographic properties (in particular, with a γ value of 10 or more) is required in the field of graphic arts to obtain good image reproduction of continuous tone by dot images or reproduction of line images.

An image-forming system has been desired which comprises developing a photographic material using a processing solution having excellent storage stability to provide super high contrast photographic properties. By way of example, a system has been proposed which comprises processing a surface latent image type silver halide photographic material containing a specific acylhydrazine compound with a developing solution containing 0.15 mol/liter or more of a sulfite preservative and having a pH value of from 11.0 to 12.3 to form a super high contrast negative image with a γ value of more than 10 as disclosed in Pat. Nos. 4,166,742, 4,168,977, 4,221,857, 4,224,401, 4,243,739, 4,272,606, and 4,311,781. This novel image-forming system is characterized in that silver iodobromide or silver iodochlorobromide can be used in contrast to conventional super high contrast image-forming systems in which only silver chlorobromide having a high silver chloride content could be used. Furthermore, the system has a comparatively good storage stability because it can contain a large amount of a sulfite preservative as against the conventional lith developing solution which could use only a slight amount of a sulfite preservative.

High contrast materials containing two kinds of silver halide grains and hydrazine derivatives are disclosed in EP 0208514, JP-A-61-223734 and JP-A-63-46437 (the term"JP-A" as used herein means an"unexamined published Japanese patent application").

A high contrast photographic material which contains a hydrazine derivative and is characterized in that the silver halide grains are spectrally sensitized in high concentration per surface area of the silver halide grain, as compared with other silver halide grains, is disclosed in the claims of JP-A-4-331951. Further, a high contrast photographic material containing silver halide grains spectrally sensitized with a non-desorptive sensitizing dye, silver halide grains not spectrally sensitized, and a hydrazine derivative is disclosed in the claims of Unexamined Published British Patent Application No. 9,407,599. In both cases, the presence of a hydrazine derivative contributes to the formation of a silver image in which spectrally sensitized light-sensitive grains and light-insensitive grains not spectrally sensitized are formed by imagewise exposure and development, further contributes to obtaining high sensitivity, saving sensitizing dyes while maintaining high concentration and improving the occurrence of residual color.

Although these photographic materials are excellent in processing stability, contrast and sensitivity, and exhibits less residual color, they have a drawback that exposure unevenness is caused when from 60 to 90% of half-tone image is outputted by an image setter.

SUMMARY OF THE INVENTION

An object of the present invention is to provide a silver halide photographic material which hardly causes exposure unevenness by an image setter, and a method for processing the same.

The above objects of the present invention have been accomplished by the following silver halide photographic material and a method for processing the same.

1) A silver halide photographic material comprising a support having provided thereon at least one light-sensitive silver halide emulsion layer and at least one light-insensitive hydrophilic colloid layer, wherein the at least one light-sensitive silver halide emulsion layer contains at least two kinds of silver halide emulsions having different speeds, the light-insensitive hydrophilic colloid layer contains at least one kind of light-insensitive silver halide grains, the silver halide emulsion layer or the light-insensitive hydrophilic colloid layer contains at least one kind of hydrazine derivative as a nucleating agent, and at least one kind of compound selected from the group consisting of an amine derivative, an onium salt, a disulfide derivative and a hydroxymethyl derivative as a nucleation accelerator.

2) The silver halide photographic material as described in the above item 1), wherein at least two kinds of silver halide emulsions having different speeds are contained in one and the same light-sensitive silver halide emulsion layer or in different light-sensitive silver halide emulsion layers.

3) The silver halide photographic material as described in the above item 2) , wherein the silver halide grains contained in at least two kinds of silver halide emulsions having different speeds have different grain sizes.

4) The silver halide photographic material as described in the above item 1), 2) or 3), wherein the silver bromide content of the light-insensitive silver halide grains is 50 mol % or more. 5) A method for processing a silver halide photographic material which comprises continuously development processing the silver halide photographic material described in the above item 1) , 2) 3) or 4), wherein the replenishing rate of a developing solution is 200 ml or less per $m^2$ of the photographic material, the developing temperature is from 30° C. to 40° C. and the developing time is from 6 to 22 seconds.

Figure 1:
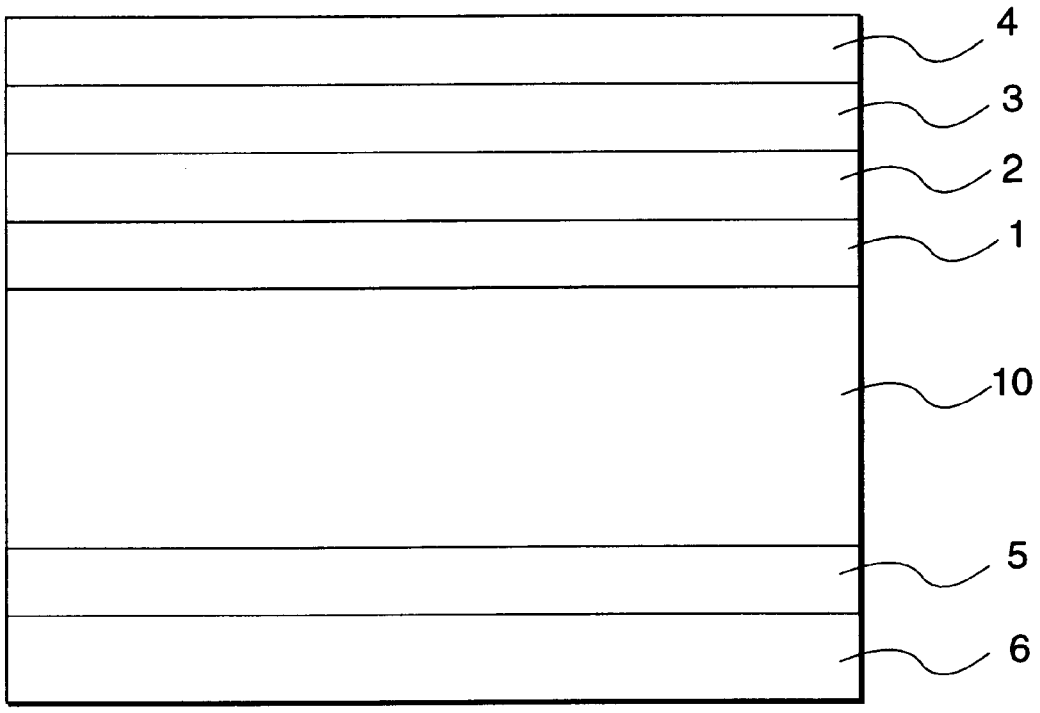
FIG. 1 is a cross-sectional conceptual drawing showing the layer constitution of the silver halide photographic material according to the present invention. Key to the Symbols.

1: Antihalation (AH) layer
2: Light-sensitive silver halide emulsion layer
3: Lower protective layer
4: Upper protective layer
5: Conductive layer
6: Backing layer
10: Support

DETAILED DESCRIPTION OF THE INVENTION

The halogen composition of the light-insensitive silver halide grains for use in the present invention is not particularly limited, and any of silver chloride, silver bromide, silver chlorobromide, silver iodobromide, silver iodochloride, and silver iodochlorobromide can be used, but silver halide grains having a silver bromide content of 50 mol % or more are preferably used. Silver iodochlorobromide having a silver bromide content of 50 mol % or more is more preferred, and silver iodobromide having a silver bromide content of 50 mol % or more is still more preferred. In the silver iodobromide of this composition, a silver iodide content is most preferably 1 mol % or less.

Light-insensitive silver halide grains may have any form such as a cubic, tetradecahedral, octahedral, amorphous, or tabular form, but a cubic form or a tetradecahedral form is preferably used.

The light-insensitive silver halide grains which are used in the present invention can be prepared according to the methods described in P. Glafkides, *Chimie et Physique Photographigue*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

The light-insensitive silver halide grains according to the present invention has blue-sensitive speed of 1/10 of the speed of the light-sensitive silver halide grains used in the photographic material of the present invention, and the light-insensitive silver halide grains are preferably not spectrally sensitized.

The light-insensitive silver halide grains according to the present invention are preferably monodispersed grains, i.e., grains having the variation coefficient represented by {(standard deviation of grain sizes)/(average grain size)}× 100 of preferably 20% or less, more preferably 15% or less are preferred. The average grain size of the light-insensitive silver halide emulsion grains is preferably from 0.1 $\mu$m or more, more preferably from 0.2 to 10 $\mu$m, and still more preferably from 0.3 to 1.0 $\mu$m.

The use amount of the light-insensitive silver halide grains for use in the present invention is preferably from 0.01 to 1 g/m$^2$ more preferably from 0.03 to 0.5 g/m$^2$.

The hydrophilic colloid layer containing light-insensitive silver halide grains according to the present invention may be provided as an antihalation layer (AH) nearer to the support than the light-sensitive silver halide emulsion layer, or may be provided as one or more protective layers farther from the support than the light-sensitive silver halide emulsion layer.

The halogen composition of the silver halide emulsion for use in the present invention is not particularly limited, and any of silver chloride, silver bromide, silver chlorobromide, silver iodobromide, silver iodochloride, and silver iodochlorobromide can be used.

Silver halide grains may have any form such as a cubic, tetradecahedral, octahedral, amorphous, or tabular form, but a cubic form or a tabular form is preferably used.

The photographic emulsions which are used in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

That is, any process, such as an acid process and a neutral process can be used. Any of a single jet method, a double jet method and a combination of these methods can be used for the reaction of a soluble silver salt with a soluble halogen salt. A method in which grains are formed in the presence of excess silver ions (a so-called reverse mixing method) can also be used. A so-called controlled double jet method, which is one form of a double jet method, in which the pAg of the liquid phase in which the silver halide is formed is maintained constant, can also be used. Further, the grain formation is preferably performed using a silver halide solvent such as ammonia, thioether, or tetra-substituted thiourea. More preferred are tetra-substituted thiourea compounds and they are disclosed in JP-A-53-82408 and JP-A-55-77737. Preferred thiourea compounds are tetramethylthiourea and 1,3-dimethyl-2-imidazolidinethione. The addition amount of a silver halide solvent differs depending upon the kinds of the compounds to be used, the objective grain sizes and the halogen compositions, but is preferably from $2\times10^{-5}$ to $1\times10^{-2}$ mol per mol of the silver halide.

Silver halide emulsions with a regular crystal form and narrow grain size distribution can easily be obtained by the controlled double jet method and the grain formation method using silver halide solvents, which is effective to prepare the silver halide emulsion for use in the present invention.

Moreover, a method in which the addition rates of silver nitrate and alkali halide are varied according to the grain growth rate as disclosed in British Patent 1,535,016, JP-B-48-36890 and JP-B-52-16364 (the term "JP-B" as used herein means an"examined Japanese patent publication"), and a method in which the concentrations of the aqueous solutions are varied as disclosed in British Patent 4,242,445 and JP-A-55-158124 are preferably and effectively used to rapidly grow grains within the range not exceeding the critical degree of saturation in order to provide uniform grain size.

The emulsion according to the present invention is preferably a monodispersed emulsion, i.e., an emulsion having the variation coefficient represented by {(standard deviation of grain sizes)/(average grain size)}×100 of preferably 20% or less, more preferably 15% or less are preferred.

The average grain size of the silver halide emulsion grains is preferably from 0.5 $\mu$m or less, more preferably from 0.1 to 0.4 $\mu$m.

The silver halide emulsion for use in the present invention is preferably chemically sensitized. Well known chemical sensitization methods such as sulfur sensitization, selenium sensitization, tellurium sensitization and noble metal sensitization can be used alone or in combination. When sensitization is performed in combination, a combination of sulfur sensitization and gold sensitization, a combination of sulfur sensitization, selenium sensitization and gold sensitization, and a combination of sulfur sensitization, tellurium sensitization and gold sensitization are preferred, for instance.

The sulfur sensitization for use in the present invention is usually performed by adding a sulfur sensitizer and stirring the emulsion at high temperature of 40° C. or more for a certain period of time. Various well-known sulfur compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfates and thioureas. The addition amount of a sulfur sensitizer is varied in accordance with various conditions such as the pH and the temperature during chemical ripening and the grain size of the silver halide grains, but is preferably from $10^{-9}$to $10^{-2}$ mol and more preferably from $10^{-5}$ to $10^{-3}$ mol, per mol of the silver halide.

Various well-known selenium compounds can be used as a selenium sensitizer in the present invention. The selenium sensitization is usually performed by adding unstable and/or non-unstable selenium compounds and stirring the emulsion at high temperature of 40° C. or more for a certain period of time. The compounds disclosed in JP-B-44-15748, JP-B-43-13489, JP-A-4-109240 and JP-A-4-324855 can be used as unstable selenium compounds. The compound represented by formula (VIII) or (IX) disclosed in JP-A-4-322855 is particularly preferably used.

Low degradable active selenium compounds can also be preferably used in the present invention. A low degradable active selenium compound is a selenium compound whose half-life is 6 hours or more when a mixed solution (pH: 6.3) in the volume ratio of 1/1 of water/1,4-dioxane comprising 10 mmol of $AgNO_3$, 0.5 mmol of a selenium compound, and 40 mmol of 2- (N-morpholino)-ethanesulfonic acid buffer is allowed to react at 40° C. As the low degradable active selenium compounds, Compounds SE-1 to SE-10 disclosed in JP-A-9-166841 are preferably used.

The tellurium sensitizer for use in the present invention is a compound which forms silver telluride, which is presumed to become sensitization speck, on the surfaces or in the interiors of silver halide grains. The formation rate of the silver telluride in the silver halide emulsion can be examined according to the method disclosed in JP-A-5-313284.

Specific examples of the sensitizers which can be used in the present invention are those disclosed in the following patents and literature: Pat. Nos. 1,623,499, 3,320,069, 3,772,013, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commnu.*, 635 (1980) , *ibid.*, 1102 (1979) , *ibid.* 645 (1979), *J. Chem, Soc. Perkin. Trans.*, 1, 2191 (1980), S. Patai compiled, *The Chemistry of Organic Selenium and Tellurium Compounds*, Vol. 1 (1986), and *ibid.*, Vol.2 (1987). The compounds represented by formula (II), (III) or (IV) disclosed in JP-A-5-313284 are particularly preferred.

The amount of the selenium and tellurium sensitizers for use in the present invention varies according to the silver halide grains used and the conditions of chemical ripening, but is generally about $10^{-8}$ to $10^{-2}$ mol, preferably about $10^{-7}$ to $10^{-3}$ mol, per mol of the silver halide. There are no particular limitations on the conditions of chemical sensitization in the present invention, but the pH is from 5 to 8, the pAg is from 6 to 11, preferably from 7 to 10, and the temperature is from 40 to 95° C., preferably from 45 to 85° C.

The noble metal sensitizers which are used in the present invention include gold, platinum, palladium and iridium, and gold sensitization is particularly preferred. Specific examples of the gold sensitizers for use in the present invention include chloroauric acid, potassium chlorate, potassium aurithiocyanate and gold sulfide, and the amount of about $10^{-7}$ to $10^{-2}$ mol per mol of the silver halide can be used.

Cadmium salt, sulfite, lead salt and thallium salt may coexist in the silver halide emulsion for use in the present invention in the process of the formation or physical ripening of silver halide grains.

Reduction sensitization can be used in the present invention. As a reduction sensitizer, stannous salt, amines, formamidinesulfinic acid, and silane compounds can be used.

Thiosulfonic acid compounds may be added to the silver halide emulsion of the present invention according to the method disclosed in EP 293917.

The light-sensitive silver halide emulsion of the present invention is spectrally sensitized with a sensitizing dye to blue light, green light, red light or infrared light. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used.

Useful sensitizing dyes for use in the present invention are disclosed in *Research Disclosure, No.* 17643, Item IV-A, p. 23 (December, 1978), ibid., No.1831, Item X, p. 437 (August, 1979) or the literature cited therein.

In particular, sensitizing dyes having spectral sensitivity suitable for spectral characteristics of light sources of various scanners, image-setters and process cameras can be advantageously selected.

The following sensitizing dyes can be advantageously selected, for example, A) for an argon laser light source, Compounds (I)-1 to (I)-8 disclosed in JP-A-60-162247, Compounds I-i to I-28 disclosed in JP-A-2-48653, Compounds I-1 to I-13 disclosed in JP-A-4-330434, compounds disclosed in Example 1 to Example 14 in U.S. Pat. No. 2,161,331, and Compounds 1 to 7 disclosed in West German Patent 936,071, B) for a helium-neon laser light source, Compounds I-1 to I-38 disclosed in JP-A-54-18726, Compounds I-1 to I-35 disclosed in JP-A-6-75322, and Compounds I-1 to I-34 disclosed in JP-A-7-287338, C) for an LED light source, Dyes 1 to 20 disclosed in JP-B-55-39818, Compounds I-1 to I-37 disclosed in JP-A-62-284343, and Compounds I-1 to I-34 disclosed in JP-A-7-287338, D) for a semiconductor laser light source, Compounds I-1 to I-12 disclosed in JP-A-59-191032, Compounds I-1 to I-22 disclosed in JP-A-60-80841, Compounds I-1 to I-29 disclosed in JP-A-4-335342, and Compounds I-1 to I-18 disclosed in JP-A-59-192242, and E) for tungsten and xenon light sources of process cameras, Compounds (1) to (19) represented by formula (I) disclosed in JP-A-55-45015, Compounds I-1 to I-97 disclosed in JP-A-9-160185, and Compounds 4-A to 4-S, 5-A to 5-Q, and 6-A to 6-T disclosed in JP-A-6-242547.

These sensitizing dyes may be used either alone or in combination of them. A combination of sensitizing dyes is often used, in particular, for the purpose of supersensitization. There may be contained in an emulsion together with sensitizing dyes a dye having no spectral sensitizing function by itself or a substance which does not substantially absorb visible light but shows supersensitization.

Useful sensitizing dyes, combinations of dyes which show supersensitization and substances which show supersensitization are disclosed in *Research Disclosure* Vol. 176, No. 17643, page 23, Item IV-J (December, 1978), and JP-B-49-25500, JP-B-43-4933, JP-A-59-19032 and JP-A-59-192242.

The sensitizing dyes for use in the present invention may be used in combination of two or more. For the inclusion of the sensitizing dyes in a silver halide emulsion, they may be directly dispersed in an emulsion, or they may be dissolved in a single or mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., and then added to an emulsion.

In addition, various methods can be used for the inclusion of the sensitizing dyes in an emulsion, for example, a method in which the sensitizing dyes are dissolved in a volatile organic solvent, the solution is dispersed in water or hydrophilic colloid and this dispersion is added to an emulsion as disclosed in U.S. Pat. No. 3,469,987, a method in which the sensitizing dyes are dissolved in acid and the solution is added to an emulsion, or the sensitizing dyes are added to an emulsion as an aqueous solution coexisting with acid or base as disclosed in JP-B-44-23389, JP-B-44-27555 and JP-B-57-22091, a method in which the dyes are added to an emulsion as an aqueous solution or a colloidal dispersion coexisting with a surfactant as disclosed in U.S. Pat. No. 3,822,135 and 4,006,025, a method in which the dyes are directly dispersed in a hydrophilic colloid and the dispersion is added to an emulsion as disclosed in JP-A-53-102733 and JP-A-58-105141, or a method in which the dyes are dissolved using a compound capable of red-shifting and the solution is added to an emulsion as disclosed in JP-A-51-74624 can be used. Further, ultrasonic waves can be used for dissolution.

The time of the addition of the sensitizing dyes for use in the present invention to the emulsion of the present invention may be at any stage of the preparation of the emulsion recognized as useful hitherto. For example, they may be added at any stage if it is before coating of the emulsion, i.e., before grain formation stage of silver halide grains or/and before desalting stage, during desalting stage and/or after desalting and before beginning of chemical sensitization, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Further, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical ripening. The kinds of compounds added separately and combinations of compounds may be different.

The addition amount of the sensitizing dye for use in the present invention differs depending on the shapes and the sizes of silver halide grains, the halogen compositions, the methods and the degrees of chemical sensitization, and the kinds of antifoggants, but it can be used in an amount of from $4\times10^{-6}$ to $8\times10^{-3}$ mol per mol of the silver halide. For example, when the silver halide grain size is from 0.2 to 1.3 $\mu$m, the addition amount is preferably from $2\times10^{-7}$ to $3.5\times10^{-6}$ mol, more preferably from $6.5\times10^{-7}$ to $2.0\times10^{-6}$ mol, per $m^2$ of the surface area of the silver halide grains. However, in the present invention, for making the speeds of two or more silver halide emulsions different, the addition amount of sensitizing dyes may be intentionally controlled. For example, the speed of the emulsion in question can be set up lower by adding the sensitizing dye in the amount less than an optimal amount.

Gelatin is preferably used as binders for the silver halide emulsion layers or other hydrophilic colloid layers of the present invention, but other hydrophilic colloids can also be used and they can be used in combination with gelatin. Examples thereof include gelatin derivatives; graft polymers of gelatin and other high polymers; proteins such as albumin and casein; cellulose derivatives such as hydroxyethyl cellulose, carboxymethyl cellulose, and cellulose sulfate; sodium alginate; sugar derivatives such as starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin can be used as gelatin as well as lime-processed gelatin, and the hydrolyzed product and the enzyme decomposed product of gelatin can also be used.

In the present invention, the coating amount of gelatin as the binder in the entire hydrophilic colloid layers on the side on which silver halide emulsion layers are provided is 3 $g/m^2$ or less (preferably from 1.0 to 3.0 $g/m^2$) , and the total amount of gelatin in the entire hydrophilic colloid layers on the side on which silver halide emulsion layers are provided and in the entire hydrophilic colloid layers on the opposite side to the side on which silver halide emulsion layers are provided is 6.0 $g/m^2$ or less, preferably from 2.0 to 6.0 $g/m^2$.

The swelling factor of the hydrophilic colloid layers including emulsion layers and protective layers of the silver halide photographic material according to the present invention is preferably from 80 to 150%, more preferably from 90 to 140%. The swelling f actor of the hydrophilic colloid layers is obtained according to the following equation by measuring the thickness of the hydrophilic colloid layers ($d_0$) including emulsion layers and protective layers of the silver halide photographic material, immersing the silver halide photographic material in distilled water of 25° C. for 1 minute and determining the swollen thickness (Δd).

$$\text{Swelling factor } (\%) = (\Delta d \div d_0) \times 100$$

As the support which can be used for putting the present invention into practice, e.g., baryta paper, polyethylene-coated paper, polypropylene synthetic paper, glass sheet, cellulose acetate, cellulose nitrate, and polyester films, such as polyethylene terephthalate can be exemplified. These supports are arbitrarily selected according to the use purpose of the silver halide photographic material.

The hydrazine derivative for use in the present invention is not restricted and any hydrazine derivative can be used but a compound represented by the following formula (I) is preferably used:

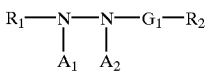

(I)

wherein $R_1$ represents an aliphatic group, an aromatic group or a heterocyclic group; $R_2$ represents a hydrogen atom or a block group; $G_1$ represents a —CO— group, an —$SO_2$— group, an —SO— group, a —CO—CO— group, a thiocarbonyl group, an iminomethylene group, or a —P (O) ($R_3$)— group; $R_3$ is selected from the same group as defined in $R_2$, and may be different from $R_2$; $A_1$ and $A_2$ each represents a hydrogen atom, or either of them represents a hydrogen atom and the other represents a substituted or unsubstituted alkylsulfonyl group, a substituted or unsubstituted arylsulfonyl group, or a substituted or unsubstituted acyl group.

The aliphatic group represented by $R_1$ in formula (I) is preferably a hydrocarbon group having from 1 to 30 carbon atoms, in particular, a straight chain, branched or cyclic alkyl group having from 1 to 20 carbon atoms. The branched alkyl group herein may be cyclized so as to form a saturated heterocyclic ring containing one or more hetero atoms. The alkyl group may have a substituent.

The aromatic group represented by $R_1$ in formula (I) is a monocyclic or bicyclic aryl group or an unsaturated heterocyclic group. The unsaturated heterocyclic group may be condensed with a monocyclic or bicyclic aryl group to form a heteroaryl group. For example, a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring can be exemplified as such rings. Among these, the heteroaryl group containing a benzene ring is preferred.

$R_1$ is particularly preferably an aryl group.

The aliphatic, aromatic or heterocyclic group represented by $R_1$ may be substituted, and representative examples of the substituents include, e.g., an alkyl group, an alkenyl group, an alkynyl group, an aryl group, a group containing a heterocyclic ring, a pyridinium group, a hydroxyl group, an alkoxyl group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having hydrazide structure, a group having quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphoric acid amido group, a diacylamino group, an imido group, a group having acylurea structure, a group containing a selenium atom or a tellurium atom, and a group having tertiary sulfonium structure or quaternary sulfonium structure. Preferred examples of the substituents include a straight chain, branched or cyclic alkyl group (preferably having from 1 to 20 carbon atoms), an aralkyl group (preferably a monocyclic or bicyclic aralkyl group the alkyl moiety of which has from 1 to 3 carbon atoms), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms) , a sulfonamido group (preferably having from 1 to 30 carbon atoms), a ureido group (preferably having from 1 to 30 carbon atoms), and a phosphoric acid amido group (preferably having from 1 to 30 carbon atoms).

The block group represented by $R_2$ in formula (I) is an alkyl group, an aryl group, an unsaturated heterocyclic group, an alkoxyl group, an aryloxy group, an amino group or a hydrazino group.

The alkyl group represented by $R_2$ in formula (I) is preferably an alkyl group having from 1 to 4 carbon atoms, and the aryl group represented by $R_2$ in formula (I) is preferably a monocyclic or bicyclic aryl group, e.g., an aryl group which contains a benzene ring.

The unsaturated heterocyclic group is a 5- or 6-membered compound containing at least one nitrogen, oxygen or sulfur atom, e.g., an imidazolyl group, a pyrazolyl group, a triazolyl group, a tetrazolyl group, a pyridyl group, a pyridinium group, a quinolinium group or a quinolinyl group. A pyridyl group and a pyridinium group are particularly preferred.

An alkoxyl group having from 1 to 8 carbon atoms is preferred as the alkoxyl group, a monocyclic aryloxy group is preferred as the aryloxy group, and an unsubstituted amino group, an alkylamino group having from 1 to 10 carbon atoms and an arylamino group are preferred as the amino group.

$R_2$ may be substituted, and groups cited as the substituents for $R_1$ can be applied to $R_2$ as preferred substituents.

Preferred groups of the groups represented by $R_2$ are, when $G_1$ represents a —CO— group, an alkyl group (e.g., methyl, trifluoromethyl, 2-carboxytetrafluoroethyl, 3-hydroxypropyl, 3-methanesulfonamidopropyl, phenylsulfonylmethyl, methyl substituted with pyridinium, etc.), an aralkyl group (e.g., o-hydroxybenzyl, etc.), and an aryl group (e.g., phenyl, 3,5-dichlorophenyl, o-methanesulfonamidophenyl, 4-methane-sulfonylphenyl, 2-hydroxymethylphenyl, etc.), and a hydrogen atom and a trifluoromethyl group are particularly preferred.

Further, when $G_1$ represents an —$SO_2$— group, preferred groups represented by $R_2$ are an alkyl group (e.g., methyl, etc.), an aralkyl group (e.g., o-hydroxybenzyl, etc.), an aryl group (e.g., phenyl, etc.), and a substituted amino group (e.g., dimethylamino, etc.).

When $G_1$ represents a —COCO— group, $R_2$ preferably represents an alkoxyl group, an aryloxy group, or a substituted or unsubstituted amino group.

$G_1$ in formula (I) preferably represents a —CO— group or a —COCO— group, and most preferably a —CO— group.

Further, $R_2$ may be such a group as to cleave the —$G_1$—$R_2$ moiety from the remainder of the molecule and generate a cyclization reaction to form a ring structure in which the atoms of the —$G_1$—$R_2$ moiety is contained, and such examples are disclosed in JP-A-63-29751, etc.

The substituents represented by $R_1$ and $R_2$ in formula (I) may further be substituted and preferred substituents include those exemplified as the substituents of $R_1$. Substituent may be substituted multiple times, that is, further substituent, substituent of the substituent, substituent of the substituent of the substituent . . . , and preferred substituents are also those exemplified as the substituents of $R_1$.

$R_1$ or $R_2$ in formula (I) may include a ballast group or a polymer which is normally used in immobile photographic additives such as couplers. Such a ballast group has eight or more carbon atoms and is a group which is photographically comparatively inactive and can be selected from, for example, an alkyl group, an aralkyl group, an alkoxyl group, a phenyl group, an alkylphenyl group, a phenoxy group and an alkylphenoxy group. Further, those disclosed, e.g., in JP-A-1-100530 can be used as such a polymer.

$R_1$ or $R_2$ in formula (I) may include a group which intensifies the adsorption onto the surface of silver halide grains. Examples of such an adsorptive group include an alkylthio group, an arylthio group, a thiourea group, a heterocyclic thioamido group, a mercapto heterocyclic group, and a triazole group as disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

The preferred hydrazine derivative for use in the present invention is a hydrazine derivative in which $R_1$ represents a ballast group, a group which accelerates adsorption onto the surface of silver halide grains, a group having quaternary ammonium structure or a phenyl group having an alkylthio group via a sulfonamido group, an acylamino group or a ureido group, $G_1$ represents a —CO— group or a —COCO— group, and $R_2$ represents a substituted alkyl group, a substituted aryl group (the preferred substituent is an electron attractive group or a hydroxymethyl group at 2-position), or a substituted or unsubstituted amino group. In addition, any combinations of the selection from the above $R_1$ and $R_2$ are possible and preferred.

Specific examples of the compounds represented by formula (I) are shown below but the present invention is not limited thereto.

Compound 1

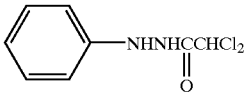

Compound 2

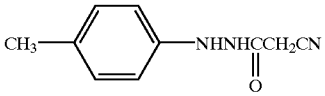

Compound 3

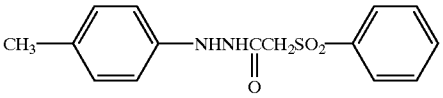

Compound 4

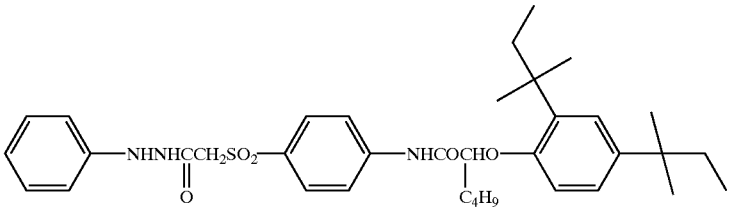

Compound 5

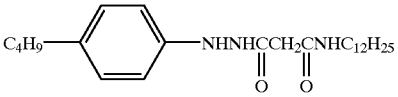

Compound 6

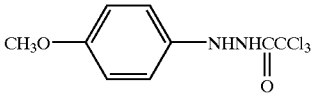

Compound 7

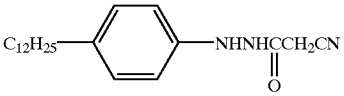

Compound 8

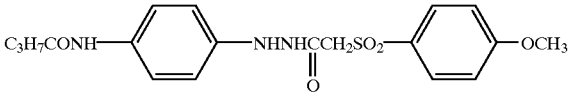

Compound 9

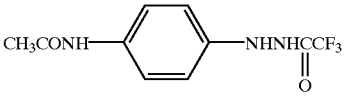

Compound 10

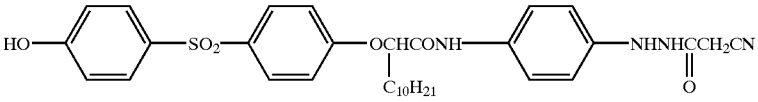

-continued
Compound 11
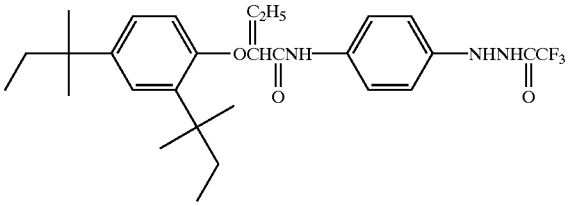
Compound 12
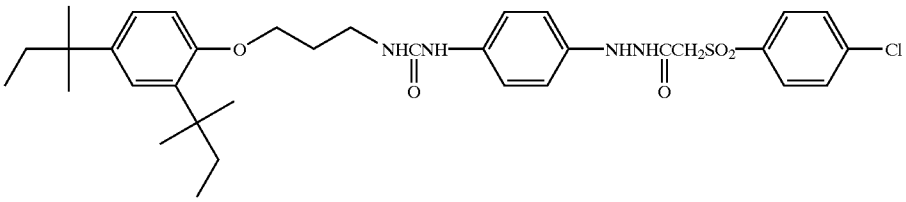
Compound 13
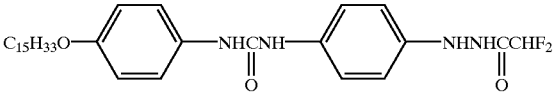
Compound 14
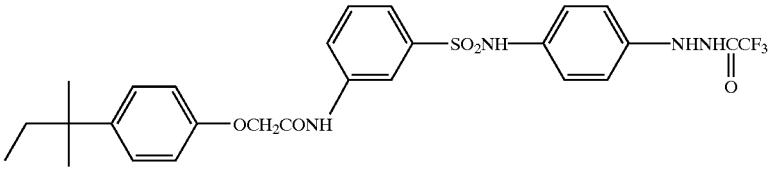
Compound 15
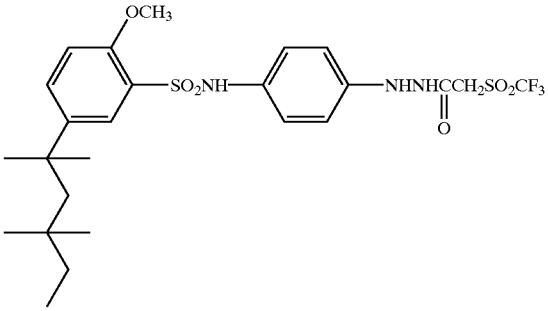
Compound 16
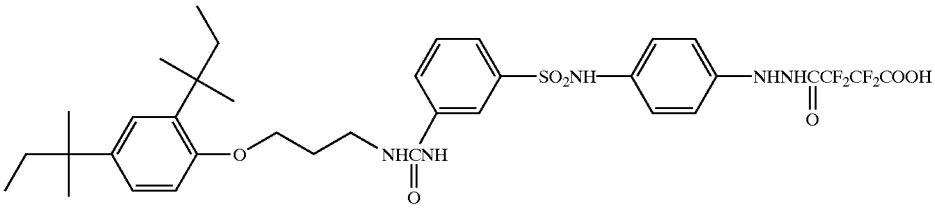
Compound 17
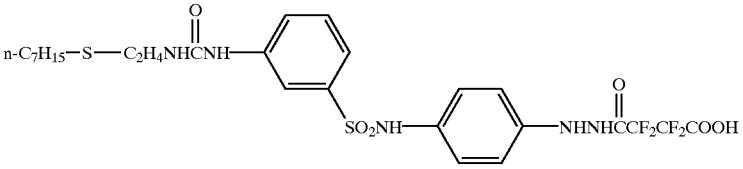
Compound 18
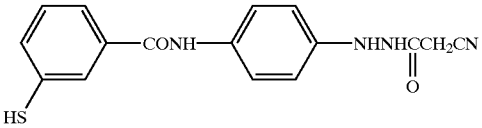
Compound 19
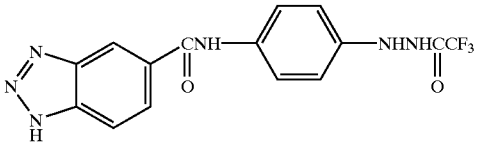

-continued
Compound 20
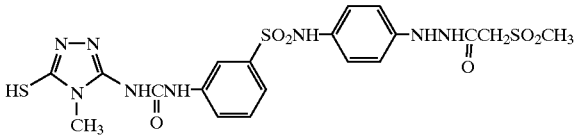
Compound 21
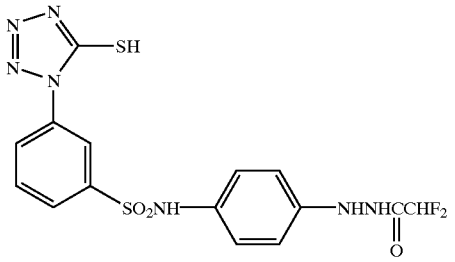
Compound 22
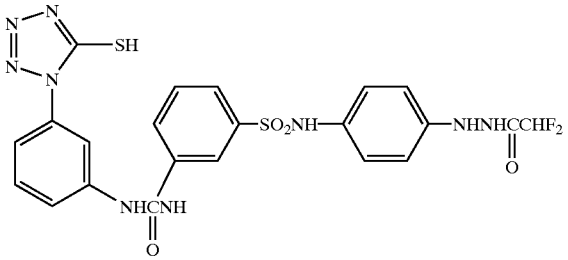
Compound 23
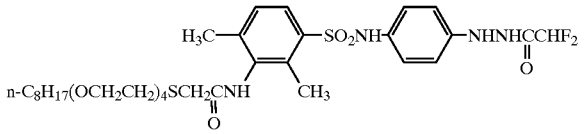
Compound 24
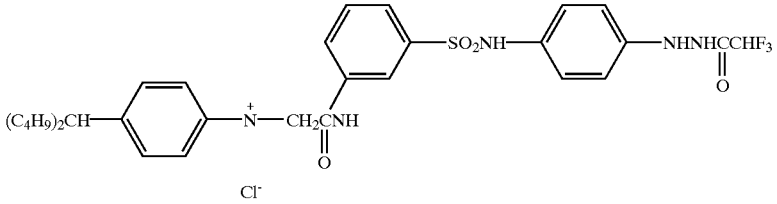
Compound 25
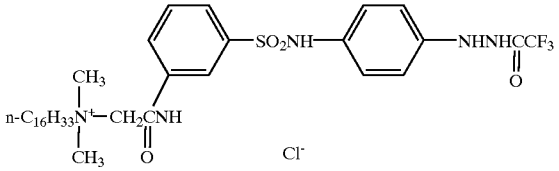
Compound 26
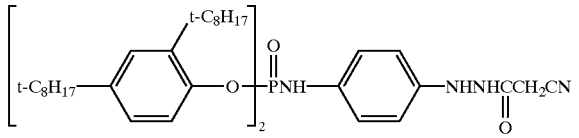
Compound 27
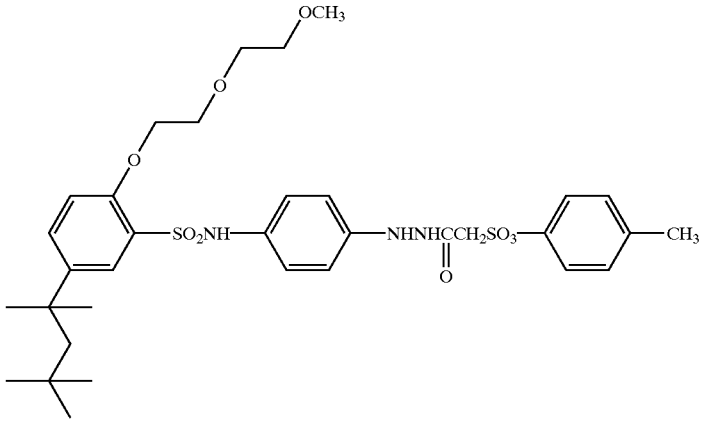

-continued
Compound 28
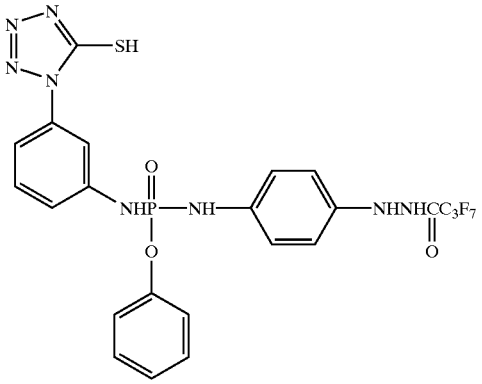
Compound 29
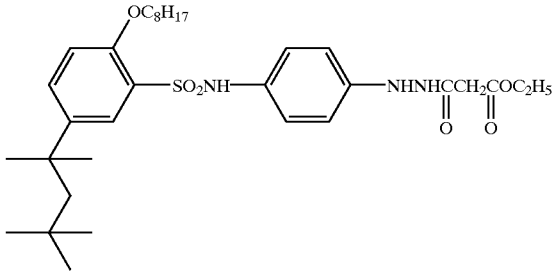
Compound 30
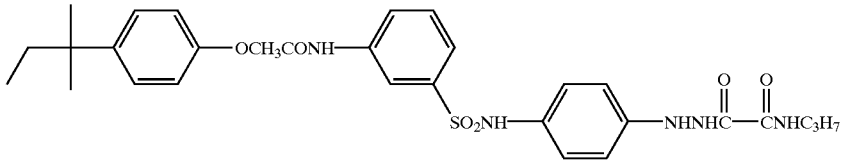
Compound 31
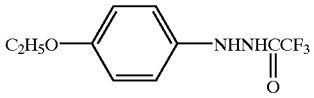
Compound 32
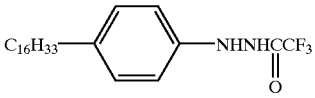
Compound 33
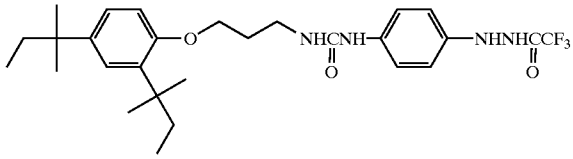
Compound 34
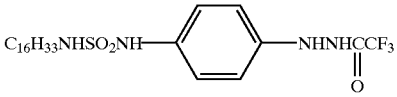
Compound 35
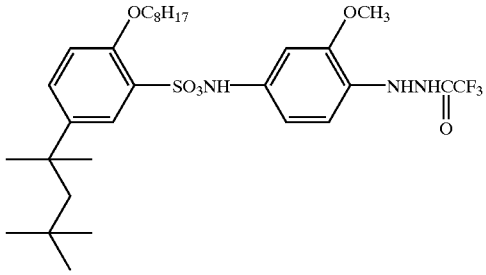

-continued
Compound 36
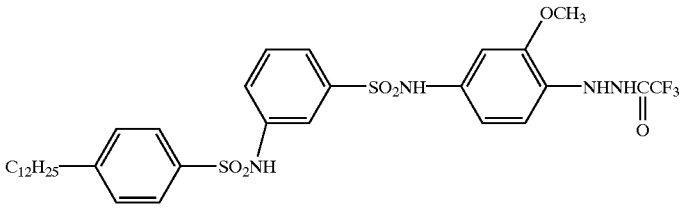
Compound 37
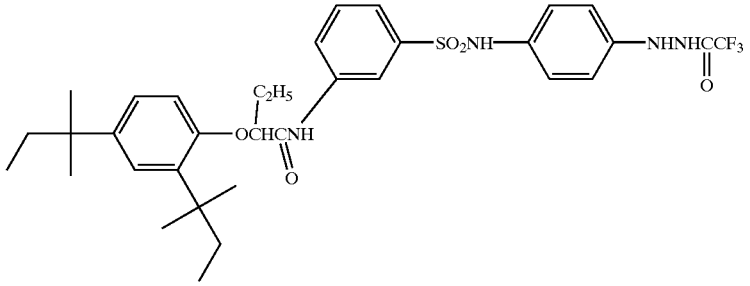
Compound 38
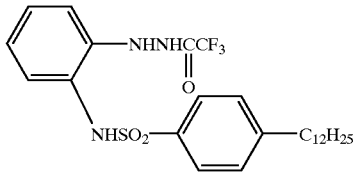
Compound 39
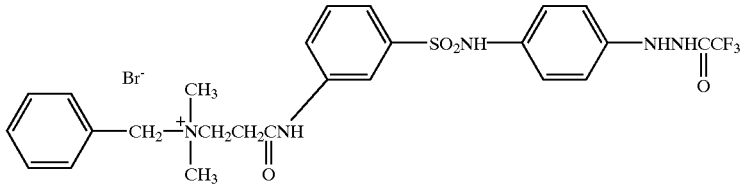
Compound 40
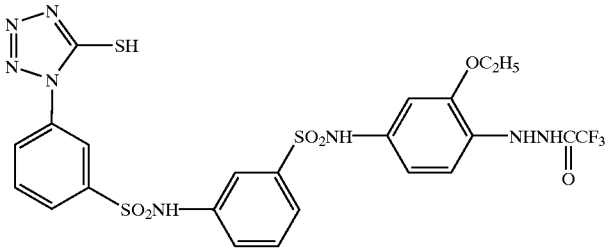
Compound 41
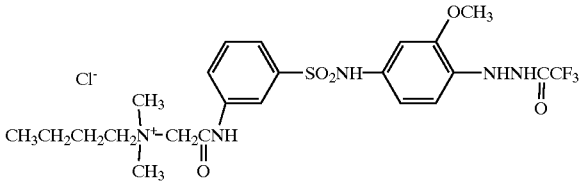
Compound 42
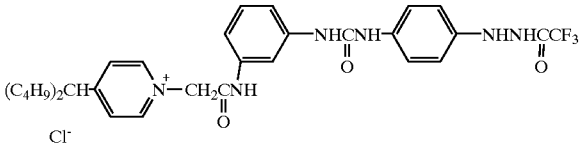
Compound 43
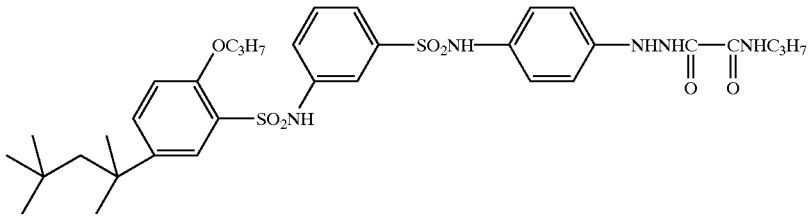

-continued
Compound 44
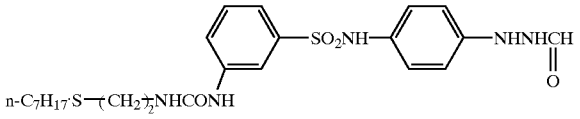
Compound 45
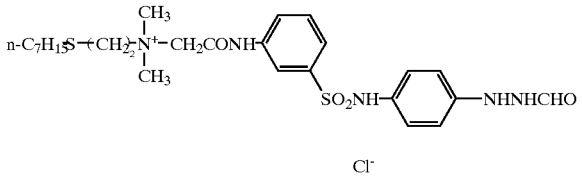
Compound 46
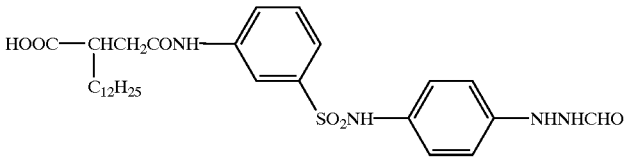
In the present invention, a compound having a plurality of acylhydrazino groups in one molecule can be used as a hydrazine derivative.
Such hydrazine derivatives are disclosed in JP-B-7-82220, JP-A-4-16938, JP-A-5-197091, JP-A-9-235266 and JP-A-9-179229.
Specific examples of these hydrazine derivatives are shown below but the present invention is not limited thereto.

B = 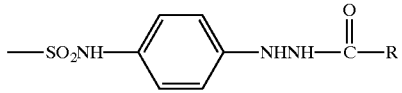
| | | R= | | | |
|---|---|---|---|---|---|
| | | —H | —$CF_3$ | —$CF_2H$ | —$CF_2CF_2COOH$ |
| 1 | 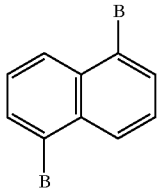 | 1a | 1b | 1c | 1d |
| 2 | 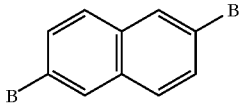 | 2a | 2b | 2c | 2d |
| 3 | 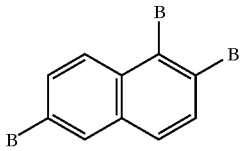 | 3a | 3b | 3c | 3d |
| 4 | 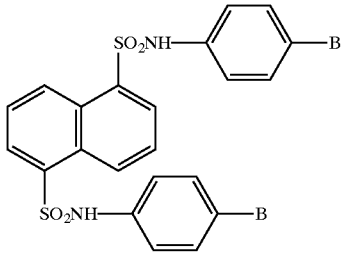 | 4a | 4b | 4c | 4d |

-continued
| | | | | | |
|---|---|---|---|---|---|
| 5 | 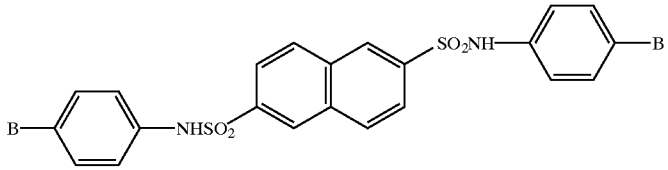 | 5a | 5b | 5c | 5d |
| 6 | 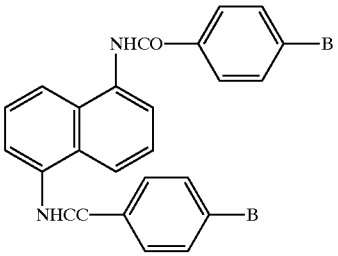 | 6a | 6b | 6c | 6d |
| 7 | 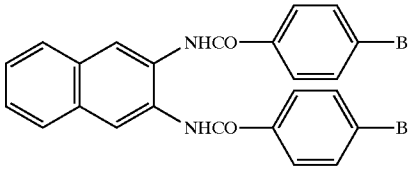 | 7a | 7b | 7c | 7d |
| 8 | 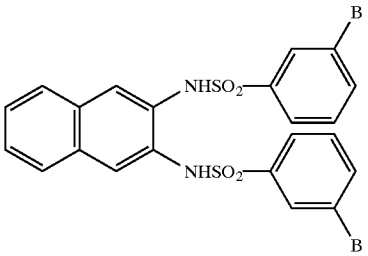 | 8a | 8b | 8c | 8d |

-continued
| | | | | | |
|---|---|---|---|---|---|
| 9 | 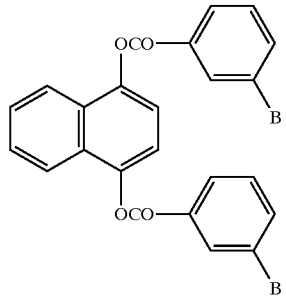 | 9a | 9b | 9c | 9d |
| 10 | 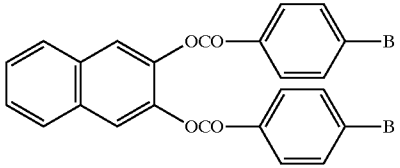 | 10a | 10b | 10c | 10d |
| 11 | 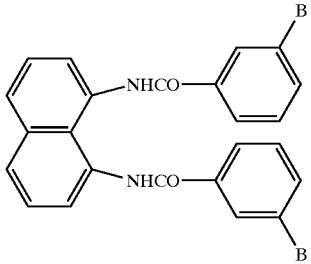 | 11a | 11b | 11c | 11d |
| 12 | 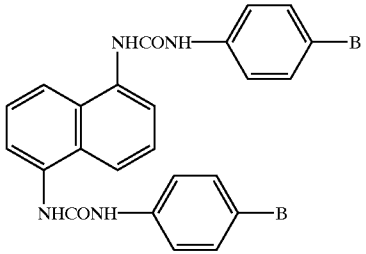 | 12a | 12b | 12c | 12d |

-continued
| | | | | | |
|---|---|---|---|---|---|
| 13 | 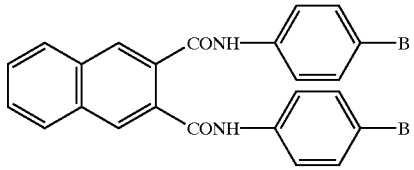 | 13a | 13b | 13c | 13d |
| 14 | 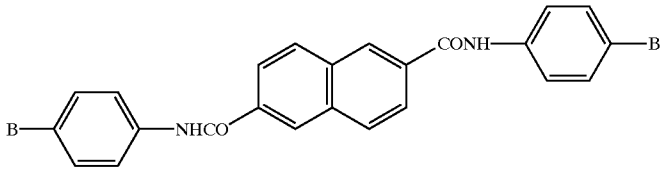 | 14a | 14b | 14c | 14d |
| 15 | 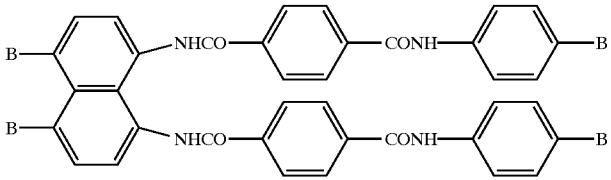 | 15a | 15b | 15c | 15d |
| 16 | 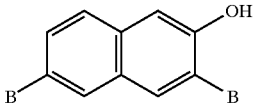 | 16a | 16b | 16c | 16d |
| 17 | 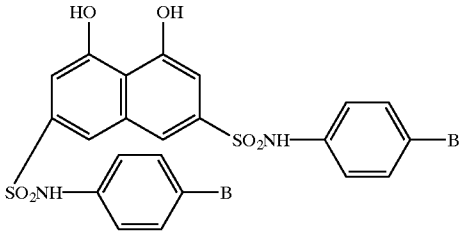 | 17a | 17b | 17c | 17d |
| 18 | 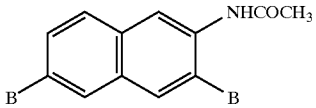 | 18a | 18b | 18c | 18d |

-continued
| | | | | | |
|---|---|---|---|---|---|
| 19 | 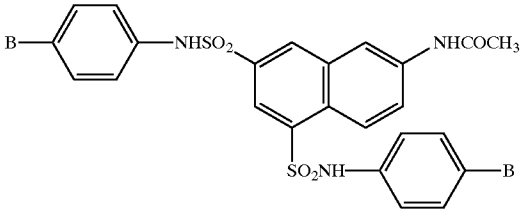 | 19a | 19b | 19c | 19d |
| 20 | 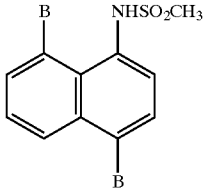 | 20a | 20b | 20c | 20d |
| 21 | 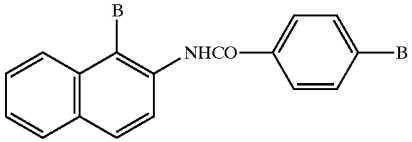 | 21a | 21b | 21c | 21d |
| 22 | 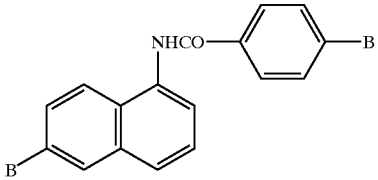 | 22a | 22b | 23c | 24d |
| 23 | 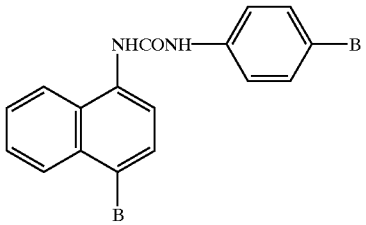 | 25a | 25b | 25c | 25d |

-continued
| | | | | | |
|---|---|---|---|---|---|
| 24 | 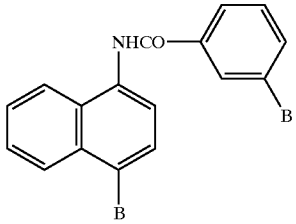 | 26a | 26b | 26c | 26d |
| 25 | 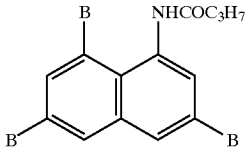 | 25a | 25b | 25c | 25d |
| 26 | 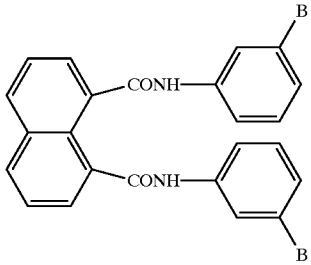 | 26a | 26b | 26c | 26d |
| 27 | 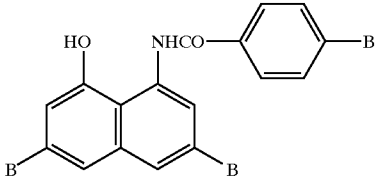 | 27a | 27b | 27c | 27d |
| 28 | 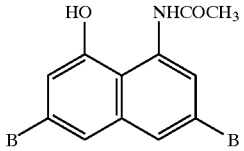 | 28a | 28b | 28c | 28d |

-continued
| | | | | | |
|---|---|---|---|---|---|
| 29 | 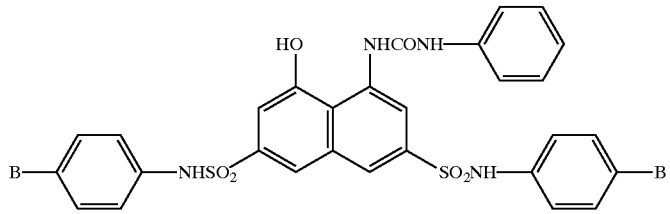 | 29a | 29b | 29c | 29d |
| 30 | 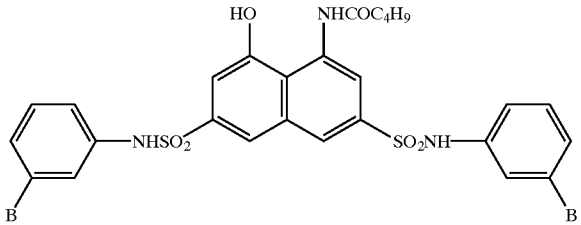 | 30a | 30b | 30c | 30d |
| 31 | 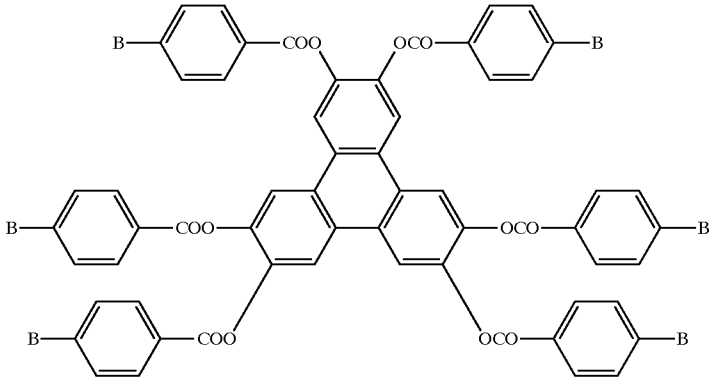 | 31a | 31b | 31c | 31d |
L = 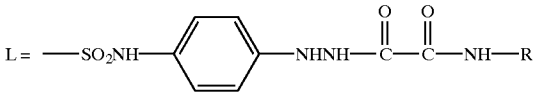
R=

-continued
| | | $-{}_nC_3H_7$ | 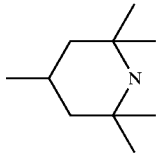 | 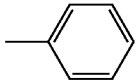 | 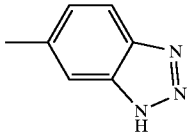 |
|---|---|---|---|---|---|
| 32 | 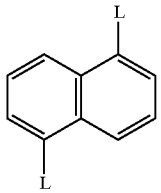 | 32e | 32f | 32g | 32h |
| 33 | 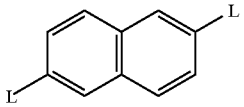 | 33e | 33f | 33g | 33h |
| 34 | 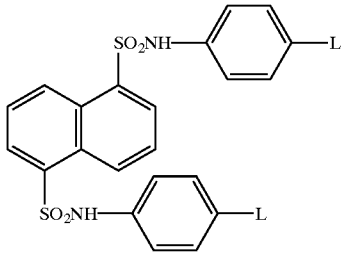 | 34e | 34f | 34g | 34h |
| 35 | 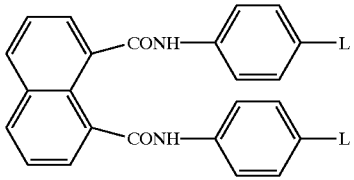 | 35e | 35f | 35g | 35h |
| 36 | 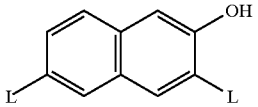 | 36e | 36f | 36g | 36h |

-continued
| | | | | | |
|---|---|---|---|---|---|
| 37 | 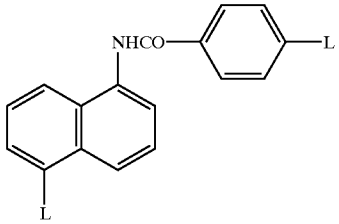 | 37e | 37f | 37g | 37h |
| 38 | 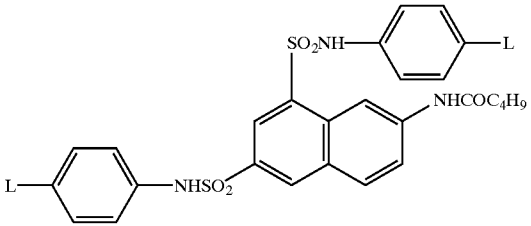 | 38e | 38f | 38g | 38h |
| 39 | 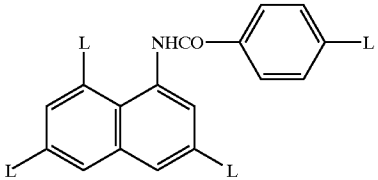 | 39e | 39f | 39g | 39h |
B = 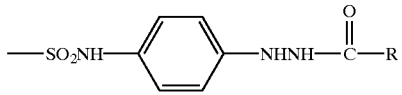
R=
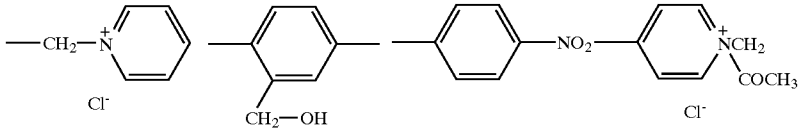

-continued

| | | | | |
|---|---|---|---|---|
| 40 | 40i | 40j | 40k | 40l |
| 41 | 41i | 41j | 41k | 41l |
| 42 | 42i | 42j | 42k | 42l |

-continued
| | | | | | |
|---|---|---|---|---|---|
| 43 | 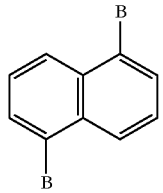 | 43i | 43j | 43k | 43l |
| 44 | 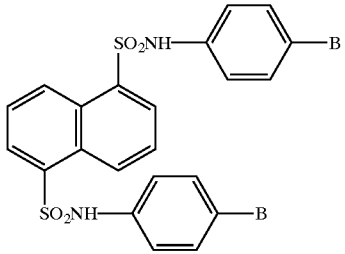 | 44i | 44j | 44k | 44l |
| 45 | 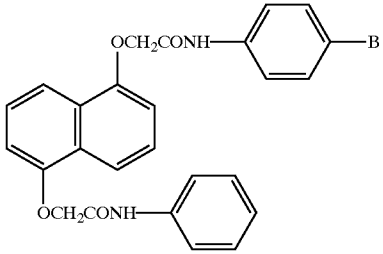 | 45i | 45j | 45k | 45l |
| 46 | 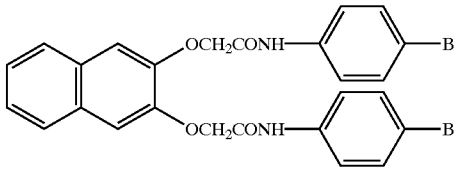 | 46i | 46j | 46k | 46l |

-continued
47
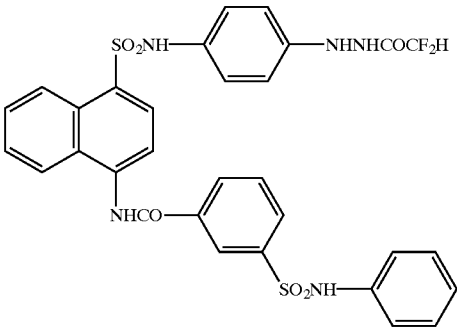
48
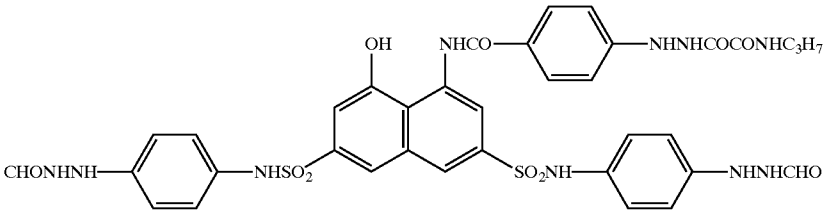
49
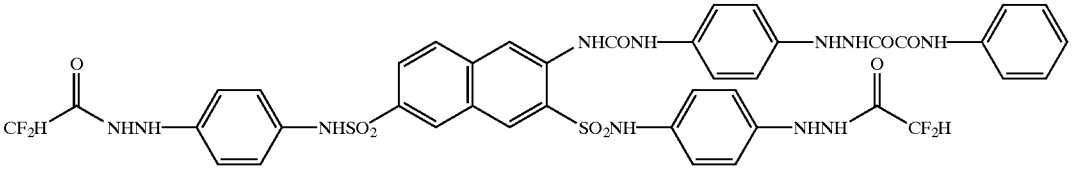
50
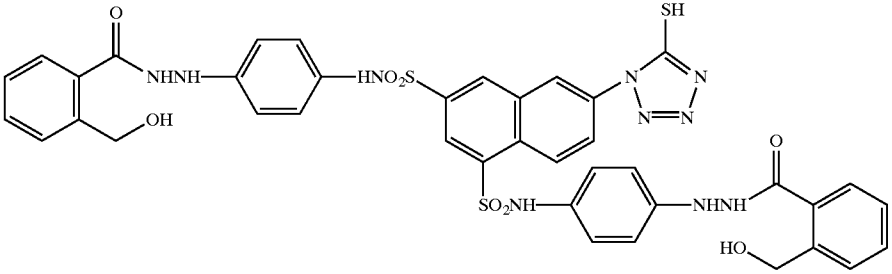

-continued
51
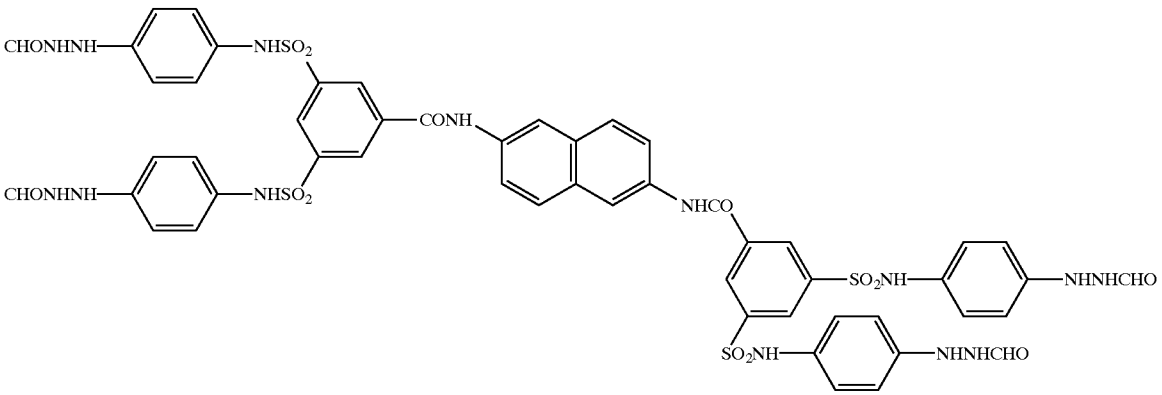

The addition amount of the hydrazine derivative for use in the present invention is preferably from $1\times10^{-6}$ mol to $5\times10^{-2}$ mol, and particularly preferably from $1\times10^{-5}$ mol to $2\times10^{-2}$ mol, per mol of the silver halide.

The hydrazine derivative is contained in emulsion layers and/or other hydrophilic colloid layers in the present invention. Other hydrophilic colloid layers include a protective layer, a layer provided between an emulsion layer and a support, and an interlayer.

The hydrazine derivatives according to the present invention can be used in the form of a solution dissolved in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the hydrazine derivatives for use in the present invention can also be used in the form of an emulsion dispersion mechanically prepared according to well-known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of hydrazine derivatives are dispersed in water using a ball mill, a colloid mill or ultrasonic wave.

The examples of the nucleation accelerators for use in the present invention include amine derivatives, onium salts, disulfide derivatives, hydroxymethyl derivatives and the like. The examples of these nucleation accelerators include the compounds disclosed in JP-A-7-77783, lines 2 to 37 on page 48, specifically, Compounds A-1) to A-73) on pages 49 to 58; the compounds represented by (ka 21), (ka 22) or (ka 23) disclosed in JP-A-7-84331, Specifically, the compounds disclosed on pages 6 to 8 of the same publication; the compounds represented by formula (Na) or (Nb) disclosed in JP-A-7-104426, specifically, Compounds Na-1 to Na-22 and Nb-1 to Nb-12 on pages 16 to 20 of the same publication; the compounds represented by formula (1), (2), (3), (4), (5), (6) or (7) disclosed in JP-A-8-272023, specifically, Compounds 1-1 to 1-19, 2-1 to 2-22, 3-1 to 3-36, 4-1 to 4-5, 5-1 to 5-41, 6-1 to 6-58 and 7-1 to 7-38 disclosed in the same publication, and the nucleation accelerators disclosed in JP-A-9-297377.

The nucleation accelerators according to the present invention can be used in the form of a solution dissolved in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the nucleation accelerators for use in the present invention can also be used in the form of an emulsion dispersion mechanically prepared according to well-known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of nucleation accelerators are dispersed in water using a ball mill, a colloid mill or ultrasonic wave.

The nucleation accelerator for use in the present invention may be added to any of the silver halide emulsion layers or other hydrophilic colloid layers on the silver halide emulsion layer side of the support but it is preferably added to the silver halide emulsion layers or the hydrophilic colloid layers adjacent thereto.

The amount of the nucleation accelerator for use in the present invention is preferably from $1\times10^{-6}$ mol to $2\times1^{-2}$ mol, more preferably from $1\times10^{-5}$ mol to $2\times10^{-2}$ mol, and most preferably from $2\times10^{-5}$ mol to $1\times10^{-2}$ mol, per mol of the silver halide.

Processing agents, such as a developing solution and a fixing solution, and processing methods according to the present invention will be described below but it should not be construed as the present invention is limited to the following description and specific examples.

Any of well-known methods and developing solutions can be used in the development processing of the present invention.

Developing agents for use in the developing solution of the present invention (hereinafter a developing starter and a developing replenisher are collectively called a developing solution) are not particularly restricted, but it is preferred for the developing solution to contain dihydroxybenzenes, ascorbic acid derivatives or hydroquinonemonosulfonate, alone or in combination. Further, combinations of dihydroxybenzenes with 1-phenyl-3-pyrazolidones, ascorbic acid derivatives with 1-phenyl-3-pyrazolidones, dihydroxybenzenes with p-aminophenols, or ascorbic acid derivatives with p-aminophenols are preferred from the point of developing property.

Dihydroxybenzene developing agents for use in the present invention include hydroquinone, chlorohydroquinone, isopropylhydroquinone, and methylhydroquinone. Hydroquinone is particularly preferred.

An ascorbic acid derivative developing agent more preferably used in the present invention is a compound represented by general formula (II):

(II)

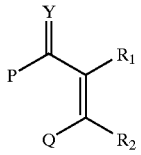

wherein $R_1$ and $R_2$ each represents a hydroxyl group, an amino group (including an amino group containing an alkyl group having from 1 to 10 carbon atoms, e.g., methyl, ethyl, n-butyl, or hydroxyethyl as a substituent), an acylamino group (e.g., acetylamino, benzoylamino, etc.), an alkylsulfonylamino group (e.g., methanesulfonylamino, etc.), an arylsulfonylamino group (e.g., benzenesulfonylamino, p-toluenesulfonylamino, etc.), an alkoxycarbonylamino group (e.g., methoxycarbonylamino, etc.), a mercapto group or an alkylthio group (e. g., methylthio, ethylthio, etc.). Preferred examples of $R_1$ and $R_2$ include a hydroxyl group, an amino group, an alkylsulfonylamino group and an arylsulfonylamino group.

P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group or a mercapto group, alternatively P and Q represent atomic groups necessary to form a 5- to 7-membered ring when connected to each other with the two vinyl carbon atoms on which $R_1$ and $R_2$ substitute and the carbon atom on which Y substitutes. Specific examples of the ring structures comprise combinations of —C—, —C($R_4$)($R_5$)—, —C($R_6$)=, —C(=O)—, —N ($R_7$)— and/or —N=, wherein $R_4$, $R_5$, $R_6$ and $R_7$ each represents a hydrogen atom, an alkyl group having from 1 to 10 carbon atoms which may be substituted (examples of the substituents include a hydroxyl group, a carboxyl group and a sulfo group), a hydroxyl group, or a carboxyl group. Further, the 5- to 7-membered ring may be condensed with a saturated or unsaturated ring.

Examples of the 5- to 7-membered rings include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring, and a uracil ring, and preferred examples of the 5- or 7-membered rings include a dihydrofuranone ring, a cyclopentenone ring, a cyclohexenone ring, a pyrazolinone ring, an azacyclohexenone ring, and a uracil ring.

Y represents a group composed of =O or =N-$R_3$, wherein $R_3$ represents a hydrogen atom, a hydroxyl group, an alkyl group (e.g., methyl, ethyl), an acyl group (e.g., acetyl), a hydroxyalkyl group (e.g., hydroxymethyl, hydroxyethyl), a sulfoalkyl group (e.g., sulfomethyl, sulfomethyl), or a carboxyalkyl group (e.g., carboxymethyl, carboxyethyl).

Specific examples of the compounds represented by general formula (II) are shown below but it should not be construed as the present invention is limited thereto.

II-1

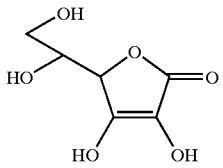

II-2

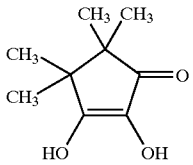

II-3

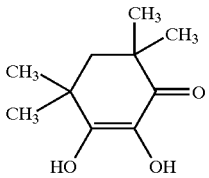

II-4

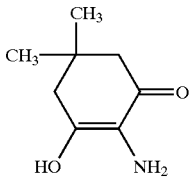

II-5

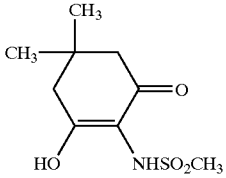

-continued

II-6

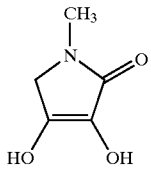

II-7

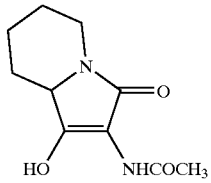

II-8

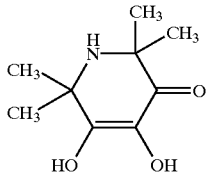

II-9

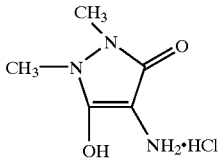

II-10

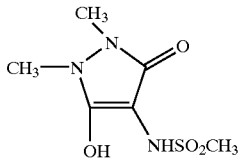

II-11

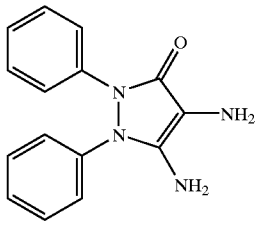

II-12

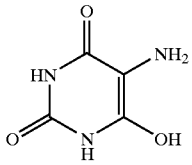

II-13

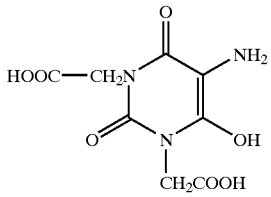

-continued
II-14
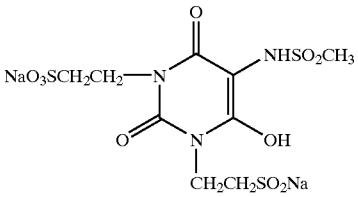
II-15
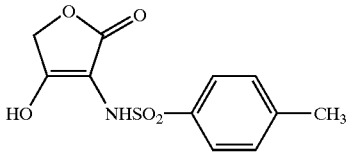
II-16
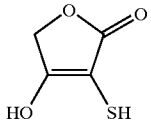
II-17
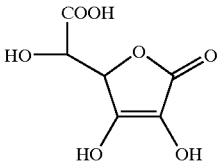
II-18
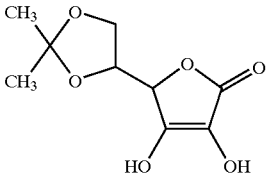
II-19
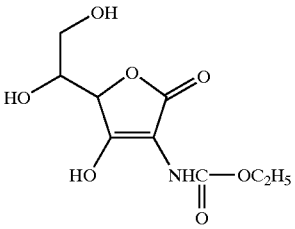
II-20
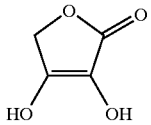
II-21
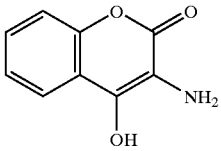
II-22
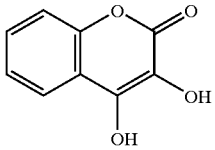
-continued
II-23
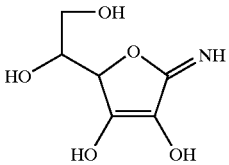
II-24
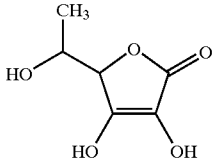
II-25
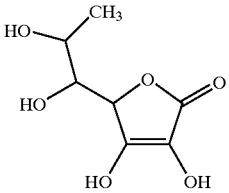
II-26
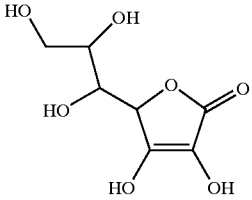
II-27
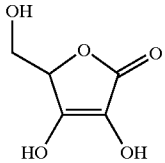
II-28
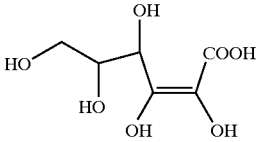
II-29
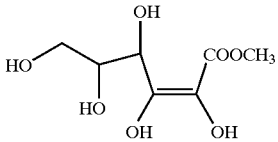
II-30
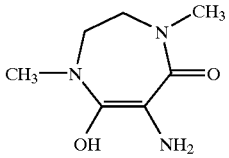
II-31
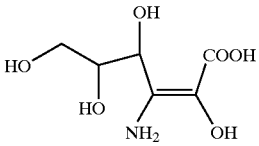
Of the above compounds, ascorbic acids or erythorbic acids (diastereomers of ascorbic acid) are preferred.

In the development processing of the photographic material described in the above items 1) to 4) and in the processing method described in the above item 5), it is preferred to use the ascorbic acid derivative represented by formula (II) as a developing agent.

Endiol type, Enaminol type, Endiamin type, Thiol-Enol type and Enamin-Thiol type compounds are generally known as the ascorbic acids for use in the developing solution of the present invention. Examples of these compounds are disclosed in U.S. Pat. No. 2,688,549 and JP-A-62-237443. These ascorbic acids can be synthesized according to well-known methods, e.g., by the methods described in Tsugio Nomura and Hirohisa Ohmura, *Reductone no Kagaku* (*Chemistry of Reductones*), Uchida Rokakuho Shinsha (1969). The ascorbic acids for use in the present invention can also be used in the form of an alkali metal salt such as a lithium salt, a sodium salt and a potassium salt.

1-Phenyl-3-pyrazolidones or derivatives thereof as a developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

p-Aminophenol developing agents for use in the present invention include N-methyl-p-aminophenol, p-aminophenol, N-(β-hydroxyphenyl)-p-aminophenol, and N-(4-hydroxyphenyl)-glycine, and N-methyl-p-aminophenol is preferred of these compounds.

A dihydroxybenzene developing agent is, in general, preferably used in an amount of from 0.05 to 0.8 mol/liter. When dihydroxybenzenes are used in combination with 1-phenyl-3-pyrazolidones or p-aminophenols, the amount used of the former is from 0.05 to 0.6 mol/liter, preferably from 0.23 to 0.5 mol/liter, and the amount used of the latter is 0.06 mol/liter or less, preferably from 0.003 to 0.03 mol/liter.

An ascorbic acid derivative developing agent is, in general, preferably used in an amount of from 0.01 to 0.5 mol/liter, more preferably from 0.05 to 0.3 mol/liter. Further, when ascorbic acid derivative is used in combination with 1-phenyl-3-pyrazolidones or p-aminophenols, the use amount of the ascorbic acid derivative is preferably from 0.01 to 0.5 mol/liter, and the 1-phenyl-3-pyrazolidones or p-aminophenols is preferably used in an amount of from 0.005 to 0.2 mol/liter.

A developing solution for processing a photographic material in the present invention can contain additives generally used (e.g., a developing agent, an alkali agent, a pH buffer, a preservative, a chelating agent, and the like). Specific examples of them are shown below but the present invention is not limited to these compounds.

Examples of buffers which are used in a developing solution for development processing a photographic material according to the present invention include carbonate, the boric acids disclosed in JP-A-62-186259, the saccharides (e.g., saccharose) disclosed in JP-A-60-93433, oximes (e.g., acetoxime), phenols (e.g., 5-sulfosalicylic acid) and tertiary phosphate (e.g., sodium salt, potassium salt), and carbonate and boric acid are preferably used. The use amount of a buffer, in particular carbonate, is preferably 0.1 mol/liter or more, particularly preferably from 0.2 to 1.5 mol/liter.

Examples of the preservatives which can be used in the developing solution for use in the present invention include sodium sulfite, potassium sulfite, lithium sulfite, ammonium sulfite, sodium bisulfite, potassium metabisulfite, and sodium formaldehyde bisulfite. Preferred addition amount of the sulfite as a preservative is 0.2 mol/liter or more, particularly preferably 0.3 mol/liter or more, but as too much an amount causes silver contamination of the developing solution, the upper limit is preferably 1.2 mol/liter, particularly preferably from 0.35 to 0.7 mol/liter.

A small amount of ascorbic acid derivatives may be used in combination with sulfite as a preservative when a dihydroxybenzene developing agent is used. The use of sodium erythorbate is economically preferred. The addition amount of ascorbic acid derivatives is preferably from 0.03 to 0.12, particularly preferably from 0.05 to 0.10, in the molar ratio to the dihydroxybenzene developing agent. When ascorbic acid derivatives are used as a preservative, it is preferred not to contain boron compounds in the developing solution.

Additives besides the above compounds which can be used in the present invention include a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, imidazole or derivatives thereof; and a physical development unevenness inhibitor such as a heterocyclic mercapto compound (e.g., sodium 3-(5-mercaptotetrazol-1-yl)benzene sulfonate, 1-phenyl-5-mercaptotetrazole) and the compounds disclosed in JP-A-62-212651.

Further, mercapto-based compounds, indazole-based compounds, benzotriazole-based compounds and benzimidazole-based compounds can be used as an antifoggant or a black pepper inhibitor. Specific examples include 5-nitroindazole, 5-p-nitrobenzoylaminoindazole, 1-methyl-5-nitroindazole, 6-nitro-indazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole, and2-mercaptobenzotriazole. The addition amount of these compounds is, in general, from 0.01 to 10 mmol, more preferably from 0.1 to 2 mmol, per liter of the developing solution.

Further, various kinds of organic and inorganic chelating agents can be used alone or in combination in the developing solution of the present invention.

Examples of inorganic chelating agents include sodium tetrapolyphosphate and sodium hexametaphosphate.

On the other hand, as organic chelating agents, organic carboxylic acid, aminopolycarboxylic acid, organic phosphonic acid, aminophosphonic acid, and organic phosphonocarboxylic acid can be primarily used.

Examples of organic carboxylic acids include acrylic acid, oxalic acid, malonic acid, succinic acid, glutaric acid, gluconic acid, adipic acid, pimelic acid, aci-elaidic acid, sebacic acid, nonanedicarboxylic acid, decanedicarboxylic acid, undecanedicarboxylic acid, maleic acid, itaconic acid, malic acid, citric acid, and tartaric acid.

Examples of aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds disclosed in JP-A-52-25632, JP-A-55-67747, JP-A-57-102624, and JP-B-53-40900.

Examples of organic phosphonic acids include the hydroxyalkylidene-diphosphonic acids disclosed in U.S. Pat. Nos. 3,214,454, 3,794,591and West German Patent Publication No. 2,227,369, and the compounds disclosed in *Research Disclosure*, Vol.181, Item 18170 (May, 1979).

Examples of aminophosphonic acids include aminotris-(methylenephosphonic acid), ethylenediaminetetramethylene-phosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, No. 18170.

These organic and/or inorganic chelating agents are not limited to the above-described compounds and they may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

Further, the developing solution according to the present invention can contain the following compounds as a silver contamination-preventing agent, in addition to the compounds disclosed in JP-A-56-24347, JP-B-56-46585, JP-B-62-2849 and JP-A-4-362942, triazine having one or more mercapto groups (e.g., the compounds disclosed in JP-B-6-23830, JP-A-3-282457, JP-A-7-175178), pyrimidine having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine), pyridine having one or more mercapto groups (e.g., 2-mercaptopyridine, 2,6-dimercaptopyridine, 3,5-dimercaptopyridine, 2,4,6-trimercaptopyridine, the compounds disclosed in JP-A-7-248587), pyrazine having one or more mercapto groups (e.g., 2-mercaptopyrazine, 2,6-dimercaptopyrazine, 2,3-dimercaptopyrazine, 2,3,5-trimercaptopyrazine) pyridazine having one or more mercapto groups (e.g., 3-mercaptopyridazine, 3,4-dimercaptopyridazine, 3,5-dimercaptopyridazine, 3,4,6-trimercaptopyridazine), the compounds disclosed in JP-A-7-175177, and the polyoxyalkylphosphonate disclosed in U.S. Pat. No. 5,457,011. These silver contamination-preventing agents can be used alone or in combination of two or more, and they are used in an amount of preferably from 0.05 to 10 mmol, more preferably from 0.1 to 5 mol, per liter of the developing solution.

Further, the compounds disclosed in JP-A-61-267759 can be used as a dissolution aid. If necessary, the developing solution may contain a toning agent, a surfactant, a defoaming agent and a hardening agent.

The pH of the developing solution according to the present invention is preferably from 8.5 to 12.0, and particularly preferably from 8.5 to 11.0. As an alkali agent which is used for adjusting pH, water-soluble inorganic alkali metal salts generally used (e.g., sodium hydroxide, potassium hydroxide, sodium carbonate, potassium carbonate) can be used.

As the cation in a developing solution, a potassium ion does not inhibit development so much as a sodium ion does, and provides less fringes around the blackened part compared with a sodium ion. Further, when a developing solution is preserved as a concentrated solution, a potassium salt has in general higher solubility, hence preferred. However, since a potassium ion in a fixing solution inhibits fixation in the same degree as a silver ion does, if the potassium ion concentration in a developing solution is high, the potassium ion concentration in a fixing solution becomes high by the developing solution carried over with a photographic material, which is not preferred. Accordingly, the molar ratio of the potassium ion to the sodium ion in a developing solution is preferably from 20/80 to 80/20. The ratio of the potassium ion to the sodium ion in a developing solution can be arbitrarily adjusted within the above range by the counter cation of a pH buffer, a pH adjustor, a preservative, a chelating agent, etc.

The replenishing rate of the developing solution according to the present invention is 200 ml or less, preferably from 30 to 200 ml, and most preferably from 60 to 180 ml, per $m^2$ of the photographic material.

The composition and/or the concentration of the developing replenisher may be the same as or different from those of the developing starter.

Ammonium thiosulfate, sodium thiosulfate and sodium ammonium thiosulfate can be used as the fixing agent of fixing processing chemicals in the present invention. The use amount of the fixing agent can be varied arbitrarily and is generally from about 0.7 to about 3.0 mol/liter.

The fixing solution according to the present invention may contain a water-soluble aluminum salt and a water-soluble chromium salt having a function as a hardening agent. Preferred compounds are a water-soluble aluminum salt, e.g., aluminum chloride, aluminum sulfate, potassium alum, aluminum ammonium sulfate, aluminum nitrate and aluminum lactate. They are preferably contained in an amount of from 0.01 to 0.15 mol/liter in terms of an aluminum ion concentration in the working solution.

When the fixing solution is preserved as a concentrated solution or a solid agent, it may comprise a plurality of parts with a hardening agent as a separate part or it may comprise one part type constitution including all the components.

The fixing processing chemicals can contain, if desired, a preservative (e.g., sulfite, bisulfite or metabisulfite, in an amount of 0.015 mol/liter or more, preferably from 0.02 mol/liter to 0.3 mol/liter), a pH buffer (e.g., acetic acid, sodium acetate, sodium carbonate, sodium hydrogencarbonate, phosphoric acid, succinic acid, and adipic acid, in an amount of from 0.1 mol/liter to 1 mol/liter, preferably from 0.2 mol/liter to 0.7 mol/liter), and a compound having an aluminum-stabilizing property and a hard water-softening property (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives thereof and salts thereof, saccharides and boric acid in an amount of from 0.001 mol/liter to 0.5 mol/liter, preferably from 0.05 mol/liter to 0.3 mol/liter).

In addition, the fixing processing chemicals can contain the compounds disclosed in JP-A-62-78551, a pH adjustor (e.g., sodium hydroxide, ammonia, sulfuric acid), a surfactant, a wetting agent, and a fixing accelerator. Specific examples of the surfactants include an anionic surfactant (e.g., a sulfated product, a sulfonated product) , a polyethylene-based surfactant, and the amphoteric surfactants disclosed in JP-A-57-6840. Well-known defoaming agents can also be used. Specific examples of the wetting agents include alkanolamine and alkylene glycol. Specific examples of the fixing accelerators which can be used in the present invention include the alkyl- and aryl-substituted thiosulfonic acid and the salts thereof disclosed in JP-A-6-308681, the thiourea derivatives disclosed in JP-B-45-35754, JP-B-58-122535 and JP-B-58-122536, an alcohol having a triple bond in the molecule, the thioether compounds disclosed in U.S. Pat. No. 4,126,459, the mercapto compounds disclosed in JP-A-1-4739, JP-A-1-159645 and JP-A-3-101728, the mesoionic compounds disclosed in JP-A-4-170539, and thiocyanate.

The pH of the fixing solution for use in the present invention is 4.0 or more and preferably from 4.5 to 6.0. The pH of the fixing solution rises according to processing by the mixture of a developing solution. In such a case the pH of a hardening fixing solution is 6.0 or less, preferably 5.7 or less, and that of a non-hardening fixing solution is 7.0 or less, preferably 6.7 or less.

The replenishing rate of the fixing solution is 500 ml/$m^2$ or less, preferably 300 ml/$m^2$ or less, more preferably from 60 to 200 ml/$m^2$ of the photographic material. The fixing replenisher may have the same composition and/or the concentration with the fixing starter or may have the same concentration with the fixing starter.

Silver recovery from a fixing solution can be carried out according to known fixing solution-reclaiming methods, such as electrolytic silver recovery, and the regenerated solution after the silver recovery can be used in the present invention. Reclaim R-60 manufactured by Fuji Hunt Co., Ltd. can be exemplified as such a reclaiming device.

Further, the removal of dyes and the like using an adsorptive filter such as an activated carbon is also preferred.

A photographic material is subjected to washing or stabilizing processing after being development processed and fixing processed (hereinafter washing includes stabilization processing and the solution used therefor is called water or washing water unless otherwise indicated). The water which is used for washing may be any of city water, ion exchange water, distilled water, and stabilizing solution. The replenishing rate of washing water is generally from about 8 liters to about 17 liters per $m^2$ of the photographic material, but washing can be performed with the less replenishing rate. In particular, with a replenishing rate of 3 liters or less (including zero, i.e., washing in a reservoir), not only water saving processing can be effected but also piping for installation of an automatic processor is not required. When washing is performed with a reduced amount of water, it is preferred to use a washing tank equipped with a squeegee roller or a crossover roller disclosed in JP-A-63-18350 and JP-A-62-287252. The addition of various kinds of oxidizing agents (e.g., ozone, hydrogen peroxide, sodium hypochlorite, activated halogen, chlorine dioxide, sodium carbonate, hydrogen peroxide) and the provision of filters may be combined to reduce load in environmental pollution which becomes a problem when washing is performed with a small amount of water and to prevent generation of scales.

A multistage countercurrent system (e.g., two stages or three stages) has been known for long as a means for reducing the replenishing rate of washing water, and the replenishing rate of washing water in this system is preferably from 50 to 200 ml per $m^2$ of the photographic material. This is also effective in an independent multistage system (a method which is not a countercurrent system and fresh solution is replenished separately to multistage washing tanks).

Furthermore, a means of preventing generation of scales may be provided in the washing process according to the present invention. A means of preventing generation of scales is not particularly limited and known methods can be arbitrarily used, for example, a method of adding antimold agents (a so-called scale-preventing agent), a method by electroconduction, a method of irradiating ultraviolet rays, infrared rays or far infrared rays, a method of applying magnetic field, a method by ultrasonic wave processing, a method by heating, and a method of emptying tanks when they are not used. These scale-preventing means may be performed in accordance with the processing of photographic materials, may be performed at regular intervals irrespective of use conditions, or may be conducted only during the time when processing is not conducted, for example, during night. In addition, washing water provided with such a means in advance may be replenished. It is also preferred to perform different scale-preventing means for every given period of time for inhibiting the proliferation of resisting fungi.

An antimold agent is not particularly limited and known antimold agents can be used. Examples antimold agents include, e.g., a chelating agent such as glutaraldehyde and aminopolycarboxylic acid, cationic surfactants, and mercapto-pyridine oxide (e.g., 2-mercaptopyridine-N-oxide), in addition to the above-described oxidants, and they can be used alone or in combination of two or more.

Methods by electroconduction disclosed in JP-A-3-224685, JP-A-3-224687, JP-A-4-16280 and JP-A-4-18980 can be utilized in the present invention.

Furthermore, well-known water-soluble surfactants or defoaming agents may be contained in washing water for preventing generation of irregulars due to foaming and transfer of stains. Further, the dye-adsorbents disclosed in JP-A-63-163456 may be included in a washing system to inhibit contamination by dyes dissolved out from photographic materials.

All or a part of the overflow from the washing process can also be utilized by mixture in a processing solution having fixing ability as disclosed in JP-A-60-235133. It is also preferred from the viewpoint of environmental protection for the washing solution to be processed by various processes before being drained, e.g., biochemical oxygen demand (BOD), chemical oxygen demand (COD), iodine consumption, etc., are reduced by a microorganism process (e.g., processes using sulfur oxide fungus and activated sludge, a process using a filter of a porous carrier such as activated carbon or ceramic carrying microorganisms) and an oxidation process by electroconduction and oxidants, or silver is precipitated by adding a compound which forms a hardly soluble silver complex such as trimercaptotriazine and filtrated using a filter of a polymer having affinity with silver and to reduce the silver concentration in water drained.

Also, when a photographic material is subjected to stabilizing processing after washing processing, a bath containing the compounds disclosed in JP-A-2-201357, JP-A-2-132435, JP-A-1-102553 and JP-A-46-44446 may be used as a final bath. This stabilizing bath may also contain, if desired, ammonium compounds, metallic compounds such as Bi and Al, brightening agents, various kinds of chelating agents, film pH adjustors, hardening agents, sterilizers, antimold agents, alkanolamines, and surfactants.

Additives such as antimold agents and stabilizing agents which are added to a washing bath and a stabilizing bath can also be solid agents the same as the above-described developing and fixing processing chemicals.

Waste solutions of the developing solution, fixing solution, washing water and stabilizing solution for use in the present invention are preferably subjected to incineration disposal. It is also possible to discard these waste solutions after being liquefied and concentrated with the concentrators as disclosed in JP-B-7-83867 and U.S. Pat. No. 5,439,560, or solidified.

When the replenishing rate of processing chemicals is reduced, it is preferred to prevent evaporation and air oxidation of the solution by minimizing the open area of the processing tank. A roller transporting type automatic processor is disclosed in U.S. Pat. Nos. 3,025,779 and 3,545,971 and referred to as merely a roller transporting type automatic processor in the specification of the present invention. The roller transporting automatic processor comprises four steps of development, fixation, washing and drying and, although the method of the present invention does not exclude other steps (e.g., stopping step), it is most preferred to follow this four step system. Further, a rinsing bath may be provided between development and fixation and/or between fixation and washing.

In development processing according to the present invention, dry to dry time is preferably from 25 to 160 seconds, with development and fixing time being 40 seconds or less respectively, preferably from 6 to 22 seconds, the temperature of each processing solution being from 25 to 50° C., preferably from 30 to 40° C. The temperature and the time of washing are preferably from 0 to 50° C. and 40 seconds or less respectively. According to the method of the present invention, photographic materials having been subjected to development, fixing and washing may be dried after the water content is squeezed out of the materials, that is, through squeegee rollers. The drying is performed at from about 40° C. to about 100° C. and the drying time can be properly varied depending upon the surroundings. Drying methods are not particularly limited and any known methods can be used, e.g., a drying method by warm air, a drying method by heat rollers and a drying method by far infrared rays as disclosed in JP-A-4-15534, JP-A-5-2256 and JP-A-5-289294, and a plurality of methods can be used in combination.

There is no particular limitation on various kinds of additives for use in the present invention and, for example, those described in the following places can be preferably used.

Polyhydroxybenzene Compound:

From line 11, right lower column, page 10 to line 5, left lower column, page 12 of JP-A-3-39948, specifically Compounds (III)-1 to (III)-25 disclosed in the same publication.

Compound which Substantially Does Not Have Absorption Maximum in Visible Region:

Compounds represented by formula (I) disclosed in JP-A-1-118832, specifically Compounds I-1 to I-26 in the same publication.

Antifoggant:

From line 19, right lower column, page 17 to line 4, right upper column, page 18 of JP-A-2-103536.

Polymer Latex:

From lines 12 to 20, left lower column, page 18 of JP-A-2-103536; the polymer latexes having an active methylene group represented by formula (I) disclosed in JP-A-9-179228, specifically Compounds I-1 to 1-16 in the same publication; polymer latexes having core/shell structure disclosed in JP-A-9-179228, specifically Compounds P-1 to P-55 in the same publication.

Matting Agent, Sliding Agent and Plasticizer:

From line 15, left upper column, page 19 to line 15, right upper column, the same page of JP-A-2-103536.

Hardening Agent;

From lines 5 to 17, right upper column, page 18 of JP-A-2-103536.

Compound Having Acid Radical:

From line 6, right lower column, page 18 to the first line, left upper column, page 19 of JP-A-2-103536.

Conductive Material:

From line 13, left lower column, page 2 to line 7, right upper column, page 3 of JP-A-2-18542, specifically metallic oxides in lines 2 to 10, right lower column, page 2, and conductive high polymer Compounds P-1 to P-7 disclosed in the same publication.

Water-soluble Dye:

From the first line to line 18, right lower column, page 17 of JP-A-2-103536.

Solid dispersion Dye:

Solid dispersion dyes represented by formula (FA) , (FA1), (FA2) or (FA3) disclosed in JP-A-9-179243, specifically Compounds F1 to F34 in the same publication; Compounds (II-2) to (II-24), Compounds (III-5) to (III-18) and Compounds (IV-2) to (IV-7) in JP-A-7-152112; solid dispersion dyes disclosed in JP-A-2-294638 and JP-A-5-11382.

Surfactant:

Surfactants disclosed in line 7, right upper column, page 9 to line 3, right lower column, the same page of JP-A-2-12236, PEG-based surfactants disclosed in lines 4 to 7, left lower column, page 18 of JP-A-2-103536; fluorine-containing surfactants disclosed in line 6, left lower column, page 12 to line 5, right lower column, page 13 of JP-A-3-39948, specifically Compounds IV-1 to VI-15 disclosed in the same publication.

Redox Compound:

Redox compounds capable of releasing a development inhibitor by oxidation disclosed in JP-A-5-274816, preferably redox compounds represented by formula (R-1), (R-2) or (R-3) in the same publication, specifically, Compounds R-1 to R-68 in the same publication.

The present invention will be described below with reference to the specific examples, but the embodiment of the present invention should not be construed as being limited thereto.

EXAMPLE 1

| Preparation of Emulsion A: | |
|---|---|
| Solution 1 | |
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate (III) (a 0.001% aqueous solution) | 20 ml |
| Potassium Hexachlororhodate (III) (a 0.001% aqueous solution) | 6 ml |

Solution 2 and Solution 3 were simultaneously added with stirring to Solution 1 maintained at 40° C. and pH 4.5 over a period of 15 minutes, and nucleus grains were formed. Subsequently, Solution 4 and Solution 5 shown below were added over a period of 15 minutes. Further, 0.15 g of potassium iodide was added thereto and grain formation was completed.

| Solution 4 | |
|---|---|
| Water | 400 ml |
| Silver Nitrate | 100 g |
| Solution 5 | |
| Water | 400 ml |
| Sodium Chloride | 27.1 g |
| Potassium Bromide | 21.0 g |
| Potassium Hexacyanoferrate (II) (a 0.1% aqueous solution) | 10 ml |

The mixture was then washed according to an ordinary flocculation method and 40 g of gelatin was added.

The pH and pAg were adjusted to 5.7 and 7.5, respectively, and 1.0 mg of sodium thiosulfate, 4.0 mg of chloroauric acid, 1.5 mg of triphenylphosphine selenide, 8 mg of sodium benzenethiosulfonate, and 2 mg of sodium benzenethiosulfinate were added and chemical sensitization was performed at 55° C. so as to reach optimal sensitivity.

Further, 100 mg of 4-hydroxy-6-methyl-1,3,3*a*,7-tetraazaindene and phenoxyethanol as a preservative were added thereto. Finally, cubic silver iodochlorobromide Emulsion A having an average grain size of 0.20 μm which contained 70 mol % of silver chloride on average and 0.08 mol % of silver iodide was obtained (variation coefficient of grain sizes: 10%).

Preparation of Emulsion C:

Emulsion C was prepared in the same manner as in the preparation of Emulsion A except that the addition time of Solution 2 and Solution 3 and the addition time of Solution 4 and Solution 5, and the temperature of Solution 1 were changed. After the emulsion had been subjected to chemical sensitization, 800 mg of 4-hydroxy-6-methyl-1,3,3*a*,7-tetraazaindene and phenoxy-ethanol as a preservative were added thereto. Finally, cubic silver iodochlorobromide Emulsion C having an average grain size of 0.18 μm which contained 70 mol % of silver chloride on average and 0.08 mol % of silver iodide was obtained (variation coefficient of grain sizes: 12%).

Preparation of Light-Insensitive Silver Halide Grains (1):

| Solution 1 | |
|---|---|
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 13.5 g |
| Potassium Bromide | 45.0 g |
| Potassium Hexachlororhodate (III) (a 0.001% aqueous solution) | 860 ml |

Solution 2 and Solution 3 were simultaneously added with stirring to Solution 1 maintained at 70° C. and pH 4.5 over a period of 15 minutes, and nucleus grains were formed. Subsequently, Solution 4 and Solution 5 shown below were added over a period of 15 minutes. Further, 0.15 g of potassium iodide was added thereto and grain formation was completed.

| Solution 4 | |
|---|---|
| Water | 400 ml |
| Silver Nitrate | 100 g |
| Solution 5 | |
| Water | 400 ml |
| Sodium Chloride | 13.5 g |
| Potassium Bromide | 45.0 g |

The mixture was then washed according to an ordinary flocculation method and 40 g of gelatin was added.

The pH and pAg were adjusted to 5.7 and 7.5, respectively, and phenoxyethanol as a preservative was added thereto. Finally, Dispersion (1) of cubic silver iodochlorobromide emulsion grains having an average grain size of 0.45 μm which contained 30 mol % of silver chloride on average and 0.08 mol % of silver iodide was obtained (variation coefficient of grain sizes: 10%).

Preparation of Light-Insensitive Silver Halide Grains (2):

| Solution 1 | |
|---|---|
| Water | 1 liter |
| Gelatin | 20 g |
| Sodium Chloride | 9.0 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Potassium Bromide | 72.0 g |
| Potassium Hexachlororhodate (III) (a 0.001% aqueous solution) | 2,000 ml |

Solution 2 and Solution 3 were simultaneously added with stirring to Solution 1 maintained at 75° C. and pH 4.5 over a period of 15 minutes, and nucleus grains were formed. Subsequently, Solution 4 and Solution 5 shown below were added over a period of 15 minutes. Further, 0.15 g of potassium iodide was added thereto and grain formation was completed.

| Solution 4 | |
|---|---|
| Water | 400 ml |
| Silver Nitrate | 100 g |
| Solution 5 | |
| Water | 400 ml |
| Potassium Bromide | 72.0 g |

The mixture was then washed according to an ordinary flocculation method and 40 g of gelatin was added.

The pH and pAg were adjusted to 5.7 and 7.5, respectively, and phenoxyethanol as a preservative was added thereto. Finally, Dispersion (2) of cubic silver iodobromide emulsion grains having an average grain size of 0.5 μm which contained 0.08 mol % of silver iodide was obtained (variation coefficient of grain sizes: 10%).

Preparation of Coated Samples 1 to 12:

Light-Insensitive Silver Halide Grains (1) or (2) were added to an upper protective layer or a lower protective layer in an amount shown in Table 1. Coated Samples 1 to 12 were prepared by coating on a support an antihalation layer, an emulsion layer, a lower protective layer and an upper protective layer in order from the support.

Emulsion Layer

Sensitizing Dye (SD-1) was added to Emulsion A in an amount of $5.7\times10^{-4}$ mol/mol Ag and spectral sensitization was performed. To Emulsion A were further added $3.4\times10^{-4}$ mol/mol of Ag of KBr, $3.2\times10^{-4}$ mol/mol of Ag of Compound (Cpd-1), $8.0\times10^{-4}$ mol/mol of Ag of Compound (Cpd-2), $1.2\times10^{-2}$ mol/mol of Ag of hydroquinone, $3.0\times10^{-3}$ mol/mol of Ag of citric acid, $1.5\times10^{-4}$ mol/mol of Ag of Compound (Cpd-3) (a hydrazine nucleating agent), $6.0\times10^{-4}$ mol/mol of Ag of Compound (Cpd-4) (a nucleation accelerator), 90 mg/m$^2$ of 2,4-dichloro-6-hydroxy-1,3,5-triazine sodium salt, a polyethyl acrylate latex and a colloidal silica having a particle size of 0.01 $\mu$m each in an amount corresponding to 30% of the gelatin binder, 100 mg/m$^2$ of an aqueous latex (aqL-5), 150 mg/m$^2$ of polyethyl acrylate dispersion, 150 mg/m$^2$ of a latex copolymer of methyl acrylate/sodium 2-acrylamido-2-methyl-propanesulfonate/2-acetoxyethyl methacrylate (88/5/7 by weight), 150 mg/m$^2$ of a core/shell type latex (core: styrene/butadiene copolymer in the weight ratio of 37/63, shell: styrene/2-acetoxyethyl methacrylate copolymer in the weight ratio of 84/16, core/shell ratio: 50/50), and Compound (Cpd-6) in an amount of 4 wt % based on the gelatin. The pH value of the solution was adjusted to 5.5 with a citric acid, thereby Emulsion Coating Solution a was prepared.

Emulsion Coating Solution c was prepared in the same manner as in the preparation of Emulsion Coating Solution a except that Emulsion C was used in place of Emulsion A and Sensitizing Dye (SD-1) was not added.

Emulsion Coating Solution a and Emulsion Coating Solution c were mixed in the ratio of ⅓ in terms of a silver amount, and the thus-obtained coating solution was coated on an undercoated polyester support having provided thereon a moisture-proofing layer containing vinylidene chloride in a silver coating weight of 3.0 g/m$^2$ and a gelatin coating weight of 1.3 g/m$^2$.

Upper Protective Layer

| | |
|---|---|
| Gelatin | 0.3 g/m$^2$ |
| Silica Matting Agent (average particle size: 3.5 $\mu$m) | 25 mg/m$^2$ |
| Light-Insensitive Silver Halide Grains (1) or (2) | the amount shown in Table 1 |
| Compound (Cpd-7) (gelatin dispersion) | 20 mg/m$^2$ |
| Colloidal Silica (particle size: 10 to 20 $\mu$m) | 30 mg/m$^2$ |

-continued

| | |
|---|---|
| Compound (Cpd-8) | 50 mg/m$^2$ |
| Sodium Dodecylbenzenesulfonate | 20 mg/m$^2$ |
| Compound (Cpd-9) | 20 mg/m$^2$ |

Lower Protective Layer

| | |
|---|---|
| Gelatin | 0.5 g/m$^2$ |
| Light-Insensitive Silver Halide Grains (1) or (2) | the amount shown in Table 1 |
| Compound (Cpd-10) | 15 mg/m$^2$ |
| 1,5-Dihydroxy-2-benzaldoxime | 10 mg/m$^2$ |
| Polyethyl Acrylate Latex | 150 mg/m$^2$ |
| Compound (Cpd-19) | 3 mg/m$^2$ |

AH Layer

| | |
|---|---|
| Gelatin | 0.5 g/m$^2$ |
| Polyethyl Acrylate Latex | 150 mg/m$^2$ |
| Compound (Cpd-6) | 40 mg/m$^2$ |
| Compound (Cpd-11) | 10 mg/m$^2$ |

The support of the sample which was used in the present invention had the backing layer and the conductive layer having the following compositions.

Backing Layer

| | |
|---|---|
| Gelatin | 3.3 g/m$^2$ |
| Compound (Cpd-12) | 40 mg/m$^2$ |
| Compound (Cpd-13) | 20 mg/m$^2$ |
| Compound (Cpd-14) | 90 mg/m$^2$ |
| Compound (Cpd-15) | 40 mg/m$^2$ |
| Compound (Cpd-16) | 26 mg/m$^2$ |
| 1,3-Divinylsulfonyl-2-propanol | 60 mg/m$^2$ |
| Polymethyl Methacrylate Fine Particles (average particle size: 6.5 $\mu$m) | 30 mg/m$^2$ |
| Liquid Paraffin | 78 mg/m$^2$ |
| Compound (Cpd-6) | 120 mg/m$^2$ |

Conductive Layer

| | |
|---|---|
| Gelatin | 0.1 g/m$^2$ |
| Sodium Dodecylbenzenesulfonate | 20 mg/m$^2$ |
| $SnO_2$/Sb (9/1 by weight ratio, average grain size: 0.25 $\mu$m) | 200 mg/m$^2$ |

SD-1

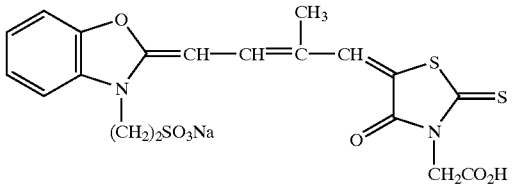

Cpd-1

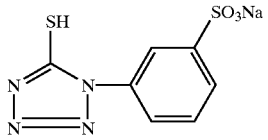

-continued
Cpd-2
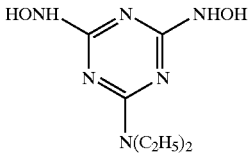
Cpd-3
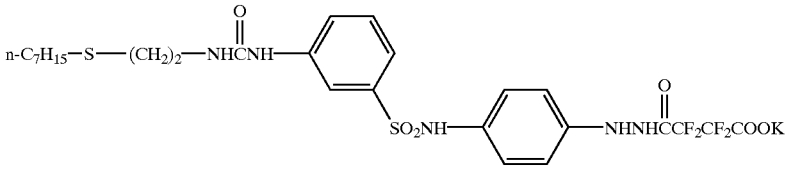
Cpd-4
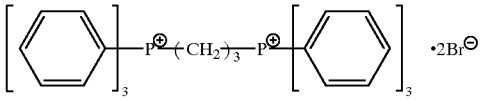
aqL-5
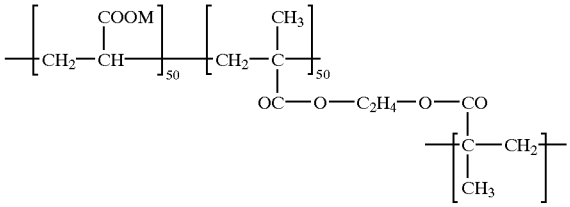
M = H or Na
Cpd-6
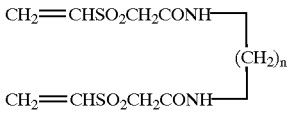
(n = 2):(n = 3) = 3:1
Cpd-7
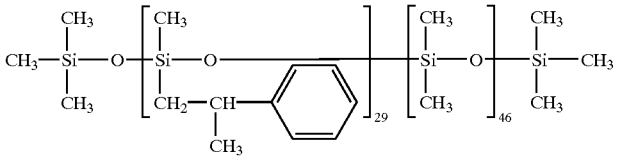
Cpd-8
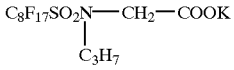
Cpd-9
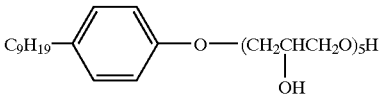
Cpd-10
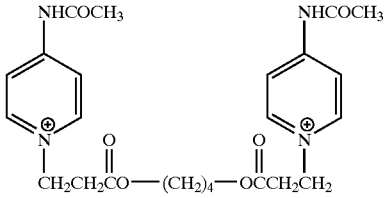
Cpd-11
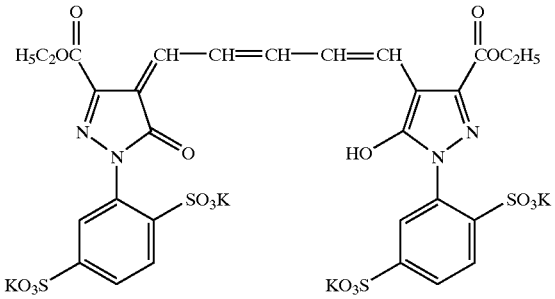

-continued

Cpd-12

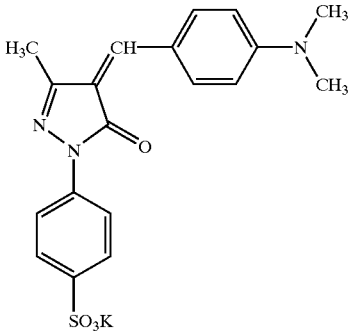

Cpd-13

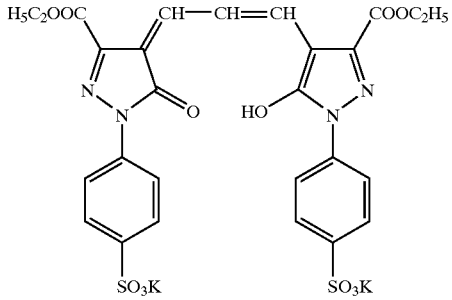

Cpd-14

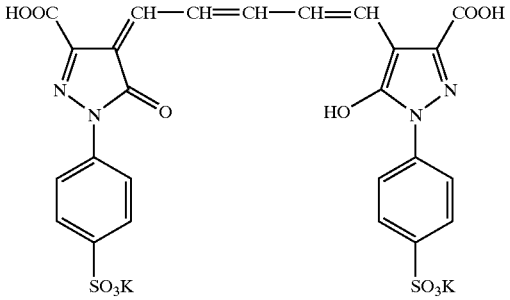

Cpd-15

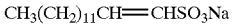

Cpd-16

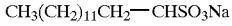

CPd-19

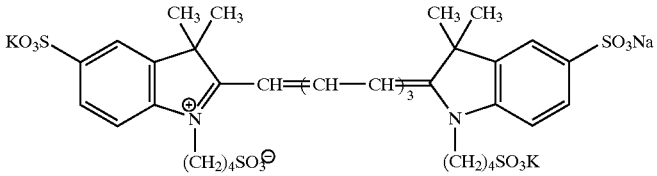

The thus-obtained sample was subjected to 80% of halftone image exposure with image setter FT-R5055 manufactured by Dai Nippon Screen Mfg. Co., Ltd.

The sample was development processed with Developing Solution A shown below at 35° C. for 20 seconds, and then underwent fixing, washing and drying processes.

The composition per liter of the concentrated solution of Developing Solution A is shown below.

Developing Solution A

| | |
|---|---|
| Potassium Hydroxide | 60.0 g |
| Diethylenetriaminepentaacetic Acid | 3.0 g |
| Potassium Carbonate | 90.0 g |
| Sodium Metabisulfate | 105.0 g |
| Potassium, Bromide | 10.5 g |
| Hydroquinone | 60.0 g |
| 5-Methylbenzenetriazole | 0.53 g |
| 4-Hydroxymethyl-4-methyl-1-phenyl-3-pyrazolidone | 2.3 g |
| Sodium 2-Mercaptobenzimidazole-5-sulfonate | 0.45 g |
| Sodium 3-(5-Mercaptotetrazol-1-yl) -benzenesulfonate | 0.15 g |
| Sodium Erythorbate | 9.0 g |
| Diethylene Glycol | 7.5 g |
| Compound (Cpd-17) | 1.5 g |
| Compound (Cpd-18) | 0.5 g |
| pH | 10.79 |

A mother solution was prepared by dilution in the proportion of 2 parts of the above concentrated solution to 1 part of water. The pH value of the mother solution was 10.65. A replenisher was prepared by dilution in the proportion of 4 parts of the above concentrated solution to 3 parts of water. The pH value of the replenisher was 10.60.

Cpd-17

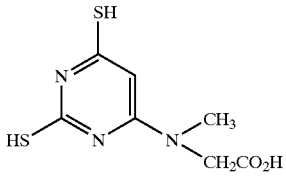

Cpd-18

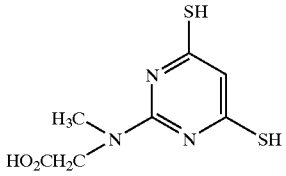

The fixing solution having the following composition was used.

Prescription of Fixing Solution

| | |
|---|---|
| Ammonium Thiosulfate | 359.1 g |
| Disodium Ethylenediaminetetraacetate | 0.09 g |

-continued

| | |
|---|---|
| Dihydrate | |
| Sodium Thiosulfate Pentahydrate | 32.8 g |
| Sodium Sulfite | 64.8 g |
| NaOH | 37.2 g |
| Glacial Acetic Acid | 87.3 g |
| Tartaric Acid | 8.76 g |
| Sodium Gluconate | 6.6 g |
| Aluminum Sulfate | 25.3 g |
| Water to make | 3 liters |
| pH (adjusted with sulfuric acid or sodium hydroxide) | 4.85 |

The replenishing rate was 200 ml/m$^2$.

The exposure unevenness of each sample was evaluated in five stages (5 was the best and 1 was the worst). The results obtained are shown in Table 1.

Results

It can be seen from the results in Table 1 that the generation of exposure unevenness is less in the samples having a hydrophilic colloid layer containing light-insensitive silver halide grains according to the present invention.

Developing Solution B having the composition shown below was used in place of Developing Solution A and evaluation was performed.

Developing Solution B

| | |
|---|---|
| Diethylenetriaminepentaacetic Acid | 2 g |
| Potassium Carbonate | 33 g |
| Sodium Carbonate | 28 g |
| Sodium Bicarbonate | 25 g |
| Sodium Erythorbate | 45 g |
| N-Methyl-p-aminophenol | 7.5 g |
| KBr | 2 g |
| 5-Methylbenzenetriazole | 0.004 g |
| 1-Phenyl-5-mercaptotetrazole | 0.02 g |
| Sodium Sulfite | 2 g |
| Water to make | 1 liter |
| pH adjusted to | 9.7 |

Results

It can be seen from the results in Table 2 that the generation of exposure unevenness is less in the samples having a hydrophilic colloid layer containing light-insensitive silver halide grains according to the present invention.

TABLE 1

| Coated Sample No. | Light-Insensitive Silver Halide Grains in Upper Protective Layer | Amount of Light-Insensitive Silver Halide Grains in Upper Protective Layer (mg/m$^2$) | Light-Insensitive Silver Halide Grains in Lower Protective Layer | Amount of Light-Insensitive Silver Halide Grains in Lower Protective Layer (mg/m$^2$) | Exposure Unevenness (5 point evaluation) | Remarks |
|---|---|---|---|---|---|---|
| 1 | None | 0 | None | 0 | 1 | Comparison |
| 2 | (1) | 85 | None | 0 | 4 | Invention |
| 3 | (1) | 200 | None | 0 | 5 | Invention |
| 4 | None | 0 | (1) | 85 | 3 | Invention |
| 5 | None | 0 | (1) | 200 | 4 | Invention |
| 6 | (1) | 100 | (1) | 100 | 5 | Invention |
| 7 | (2) | 85 | None | 0 | 3 | Invention |
| 8 | (2) | 200 | None | 0 | 4 | Invention |
| 9 | None | 0 | (2) | 85 | 5 | Invention |
| 10 | None | 0 | (2) | 200 | 5 | Invention |
| 11 | (2) | 100 | (2) | 100 | 4 | Invention |
| 12 | (1) | 100 | (2) | 100 | 4 | Invention |

EXAMPLE 2

Coated Samples 1 to 12 were subjected to exposure and development in the same manner as in Example 1 except that

TABLE 2

| Coated Sample No. | Light-Insensitive Silver Halide Grains in Upper Protective Layer | Amount of Light-Insensitive Silver Halide Grains in Upper Protective Layer (mg/m$^2$) | Light-Insensitive Silver Halide Grains in Lower Protective Layer | Amount of Light-Insensitive Silver Halide Grains in Lower Protective Layer (mg/m$^2$) | Exposure Unevenness (5 point evaluation) | Remarks |
|---|---|---|---|---|---|---|
| 1 | None | 0 | None | 0 | 1 | Comparison |
| 2 | (1) | 85 | None | 0 | 4 | Invention |
| 3 | (1) | 200 | None | 0 | 5 | Invention |
| 4 | None | 0 | (1) | 85 | 4 | Invention |
| 5 | None | 0 | (1) | 200 | 3 | Invention |
| 6 | (1) | 100 | (1) | 100 | 4 | Invention |
| 7 | (2) | 85 | None | 0 | 4 | Invention |
| 8 | (2) | 200 | None | 0 | 4 | Invention |
| 9 | None | 0 | (2) | 85 | 5 | Invention |

TABLE 2-continued

| Coated Sample No. | Light-Insensitive Silver Halide Grains in Upper Protective Layer | Amount of Light-Insensitive Silver Halide Grains in Upper Protective Layer ($mg/m^2$) | Light-Insensitive Silver Halide Grains in Lower Protective Layer | Amount of Light-Insensitive Silver Halide Grains in Lower Protective Layer ($mg/m^2$) | Exposure Unevenness (5 point evaluation) | Remarks |
|---|---|---|---|---|---|---|
| 10 | None | 0 | (2) | 200 | 4 | Invention |
| 11 | (2) | 100 | (2) | 100 | 4 | Invention |
| 12 | (1) | 100 | (2) | 100 | 5 | Invention |

EXAMPLE 3

The same samples with Sample Nos. 1 to 12 were coated in a width of 1 m and a length of 4,000 m with a coating machine to prepare coated Sample Nos. 1' to 12'. Immediately after coating, each sample was wound onto a core having a diameter of 20 cm and stored at 33° C. for 4 hours as it was. Thereafter, the temperature and humidity were restored to normal temperature and normal humidity, the web was processed to a sample product and the sample was subjected to exposure and development in the same manner as in Example 1 and evaluation was performed.

Results

It can be seen from the results in Table 3 that the generation of exposure unevenness is less in the samples having a hydrophilic colloid layer containing light-insensitive silver halide grains according to the present invention.

Cpd-22

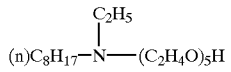

Cpd-23

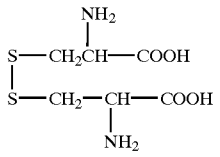

TABLE 3

| Coated Sample No. | Light-Insensitive Silver Halide Grains in Upper Protective Layer | Amount of Light-Insensitive Silver Halide Grains in Upper Protective Layer ($mg/m^2$) | Light-Insensitive Silver Halide Grains in Lower Protective Layer | Amount of Light-Insensitive Silver Halide Grains in Lower Protective Layer ($mg/m^2$) | Exposure Unevenness (5 point evaluation) | Remarks |
|---|---|---|---|---|---|---|
| 1' | None | 0 | None | 0 | 1 | Comparison |
| 2' | (1) | 85 | None | 0 | 4 | Invention |
| 3' | (1) | 200 | None | 0 | 5 | Invention |
| 4' | None | 0 | (1) | 85 | 3 | Invention |
| 5' | None | 0 | (1) | 200 | 4 | Invention |
| 6' | (1) | 100 | (1) | 100 | 4 | Invention |
| 7' | (2) | 85 | None | 0 | 4 | Invention |
| 8' | (2) | 200 | None | 0 | 5 | Invention |
| 9' | None | 0 | (2) | 85 | 5 | Invention |
| 10' | None | 0 | (2) | 200 | 4 | Invention |
| 11' | (2) | 100 | (2) | 100 | 5 | Invention |
| 12' | (1) | 100 | (2) | 100 | 4 | Invention |

EXAMPLE 4

Sample Nos. 13 to 24 were prepared in the same manner as in the preparation of Sample Nos.1 to 12 in Example 1 except that any of Compound (Cpd-22) (an amine derivative), Compound (Cpd-23) (a disulfide derivative), or Compound (Cpd-24) (a hydroxymethyl derivative) was used in an amount of $5\times10^{-5}$ mol/mol Ag in place of Compound (Cpd-4) (a nucleation accelerator). When each sample obtained was subjected to half-tone image exposure and development in the same manner as in Example 1, the same results with Sample Nos. 1 to 12 in Example 1 were obtained.

-continued

Cpd-24

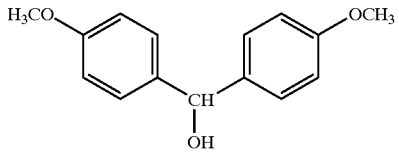

EXAMPLE 5

When each of Sample Nos. 1 to 12 was subjected to 80% of half-tone image exposure in the same manner as in Example 1 using any kind of Selectset 5000, Avantra 25 or Accuset 1000 (manufactured by Agfa Co.), Dolev 450 or Dolev 800 (manufactured by Scitex Co.), LINO 630, QUASAR, Herkules Elite, or Shignasetter (manufactured by Heidel Co.), Lux Setter RC-5600V or Luxel F-9000 (manufactured by Fuji Photo Film Co., Ltd.), or Panther Pro 62 (manufactured by Prepress Co.), in place of image setter FT-R5055 (manufactured by Dai Nippon Screen Mfg. Co., Ltd.), and then development processing, the generation of exposure unevenness was less in the samples having a hydrophilic colloid layer containing light-insensitive silver halide grains according to the present invention.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer and at least one light-insensitive hydrophilic colloid layer, wherein said at least one light-sensitive silver halide emulsion layer contains at least two kinds of silver halide emulsions having different speeds, said light-insensitive hydrophilic colloid layer contains at least one kind of light-insensitive silver halide grains, said silver halide emulsion layer or said light-insensitive hydrophilic colloid layer contains at least one kind of hydrazine derivative as a nucleating agent, and at least one kind of compound selected from the group consisting of an amine derivative, an onium salt, a disulfide derivative and a hydroxymethyl derivative as a nucleation accelerator.

2. The silver halide photographic material as claimed in claim 1, wherein at least two kinds of silver halide emulsions having different speeds are contained in one and the same light-sensitive silver halide emulsion layer or in different light-sensitive silver halide emulsion layers.

3. The silver halide photographic material as claimed in claim 2, wherein the silver halide grains contained in at least two kinds of silver halide emulsions having different speeds have different grain sizes.

4. The silver halide photographic material as claimed in claim 1, 2 or 3, wherein the silver bromide content of said light-insensitive silver halide grains is 50 mol % or more.

5. A method for processing a silver halide photographic material which comprises continuously development processing the silver halide photographic material claimed in claim 1, 2 or 3, wherein the replenishing rate of a developing solution is 200 ml or less per $m^2$ of the photographic material, the developing temperature is from 30° C. to 40° C. and the developing time is from 6 to 22 seconds.

6. A method for processing a silver halide photographic material which comprises continuously development processing the silver halide photographic material claimed in claim 4, wherein the replenishing rate of a developing solution is 200 ml or less per $m^2$ of the photographic material, the developing temperature is from 30° C. to 40° C. and the developing time is from 6 to 22 seconds.

* * * * *